US008055153B2

(12) United States Patent
Nukada et al.

(10) Patent No.: US 8,055,153 B2
(45) Date of Patent: Nov. 8, 2011

(54) IMAGE FORMING APPARATUS AND PROCESS CARTRIDGE

(75) Inventors: Katsumi Nukada, Kanagawa (JP); Wataru Yamada, Kanagawa (JP); Yukiko Furushiro, Kanagawa (JP); Takayuki Yamashita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 758 days.

(21) Appl. No.: 11/802,521

(22) Filed: May 23, 2007

(65) Prior Publication Data

US 2008/0089712 A1 Apr. 17, 2008

(30) Foreign Application Priority Data

Oct. 16, 2006 (JP) ..... 2006-281791

(51) Int. Cl.
*G03G 21/08* (2006.01)

(52) U.S. Cl. ..... 399/111; 399/128; 399/159; 430/125.2

(58) Field of Classification Search ..... 399/159, 399/128, 111; 430/58.7, 66, 125.2
See application file for complete search history.

(56) References Cited

U.S. PATENT DOCUMENTS

| | | | | |
|---|---|---|---|---|
| 5,622,798 | A | 4/1997 | Kimoto | |
| 2003/0129512 | A1* | 7/2003 | Sugino et al. | 430/66 |
| 2004/0136748 | A1* | 7/2004 | Zhang et al. | 399/128 |
| 2004/0147664 | A1* | 7/2004 | Lee et al. | 430/32 |
| 2006/0216619 | A1* | 9/2006 | Iwasaki et al. | 430/58.75 |
| 2006/0292480 | A1* | 12/2006 | Niimi | 430/126 |

FOREIGN PATENT DOCUMENTS

| | | |
|---|---|---|
| JP | A-04-189873 | 7/1992 |
| JP | A-05-043823 | 2/1993 |
| JP | A-05-098181 | 4/1993 |
| JP | A-05-140472 | 6/1993 |
| JP | A-05-140473 | 6/1993 |
| JP | A-05-263007 | 10/1993 |
| JP | A-05-279591 | 10/1993 |
| JP | A-08-115023 | 5/1996 |
| JP | A-08-176293 | 7/1996 |
| JP | A-08-208820 | 8/1996 |
| JP | A-2000-019749 | 1/2000 |

(Continued)

OTHER PUBLICATIONS

English language translation of JP 2006-010972 (Jan. 2006).*

(Continued)

*Primary Examiner* — Christopher Rodee
(74) *Attorney, Agent, or Firm* — Oliff & Berridge, PLC

(57) ABSTRACT

An image forming apparatus includes: an electrophotographic photoreceptor including a conductive support and a photosensitive layer including an outermost surface layer capable of transporting a charge, the layer being farthest from the conductive support and containing a resin having a crosslinking structure; a charging unit that charges the electrophotographic photoreceptor; a first exposure unit that exposes the electrophotographic photoreceptor to form an electrostatic latent image on the electrophotographic photoreceptor charged; a developing unit that develop the electrostatic latent image with a toner to form a toner image; a transfer unit that transfer the toner image from the electrophotographic photoreceptor to a medium to be transferred; and a second exposure unit that uniformly expose the electrophotographic photoreceptor, the outermost surface layer absorbing exposure light of the second exposure unit and having a maximum absorbance of about 0.05 or less in the entire wavelength range of the exposure light.

12 Claims, 8 Drawing Sheets

FOREIGN PATENT DOCUMENTS

| | | | |
|---|---|---|---|
| JP | A-2000-066424 | | 3/2000 |
| JP | A-2002-082469 | | 3/2002 |
| JP | B2-3287678 | | 3/2002 |
| JP | B2-3460285 | | 8/2003 |
| JP | A-2005-234546 | | 9/2005 |
| JP | A-2005-284262 | | 10/2005 |
| JP | 2006010972 | A * | 1/2006 |
| JP | A-2006-259063 | | 9/2006 |

OTHER PUBLICATIONS

Jun. 22, 2010 Office Action issued in Japanese Patent Application No. 2006-281791 (with translation).
Dec. 7, 2010 Office Action issued in Japanese Patent Application No. 2006-281791 (with translation).

* cited by examiner

IMAGE FORMING APPARATUS AND PROCESS CARTRIDGE

CROSS-REFERENCE TO RELATED APPLICATION

This application is based on and claims priority under 35 USC §119 from Japanese Patent Application No. 2006-281791 filed Oct. 16, 2006.

BACKGROUND (i) Technical Field

The present invention relates to an image forming apparatus to carry out image formation by electrophotographic process including charging, exposing, developing and transferring, and also relates to a process cartridge.

(ii) Related Art

An image forming apparatus of an electrophotographic system generally has constitution and processes as shown below. In the first place, the surface of an electrophotographic photoreceptor (hereinafter sometimes referred to as merely "a photoreceptor") is uniformly charged to a polarity and potential by a charging unit, and then charges on the surface of the photoreceptor after charging are selectively removed by image exposure to thereby form an electrostatic latent image. Subsequently, toner is adhered to the electrostatic latent image to thereby develop the latent image as a toner image by a developing unit, and the toner image is transferred to a medium to be transferred by a transfer unit, and an image formed is discharged.

From advantages that high speed and high quality of printing can be obtained, electrophotographic photoreceptors are widely used in the fields of duplicators and laser beam printers in recent years. As photoreceptors used in these image forming apparatus, organic photoreceptors using organic photoconductive materials inexpensive and having excellent advantages in productivity and discarding are accounting for main streams as compared with photoreceptors using existing inorganic photoconductive materials such as selenium, selenium-tellurium alloy, selenium-arsenic alloy, cadmium sulfide, etc.

As a charging unit of photoreceptors, a corona charging system using corona dischargers has been used. However, in recent years, a contact charging system having advantages such as low ozone and low power has been put to practical use and widely used.

The contact charging system is a system to charge the surface of a photoreceptor by contacting or extremely approaching a conductive charging member as a member for charging to the surface of the photoreceptor, and applying voltage to the charging member. As a method of applying voltage to the charging member, there are a direct current system of applying direct voltage alone, and an alternating current superimposing system of applying alternating voltage to direct voltage by superimposition. However, this contact charging system has advantages that the apparatus can be miniaturized and harmful gas, e.g., ozone, is hardly generated on one hand, deterioration and abrasion of a photoreceptor are liable to occur by direct electric discharge on the surface of the photoreceptor. Further, in the contact charging system, various foreign matters in the image forming apparatus (e.g., metal powders and carrier lumps) are liable to pierce through the photoreceptor or damage the photoreceptor. As a result, when the photoreceptor is repeatedly used for a long period of time, a high electric field is locally applied to the defect part of the photoreceptor as above at contact charging time and electrical pinhole (pinhole leak) is caused, so that a generation of image defect is liable to occur. Further, as a result of the increment of abrasion of the photoreceptor by contact charging, pinhole leak is liable to be accelerated.

Further, in recent years, for obtaining an image of high image quality, the so-called polymerization toners inclining toward spherical as compared with the shapes of pulverized toners have been often used, but as toners approach a spherical shape, the toners are liable to pass through blade cleaner in the removal of toner, so that it is necessary to closely press the blade cleaner against photoreceptor, which is also the cause of acceleration of abrasion of photoreceptors.

As transfer systems, a system of transferring a toner image directly on paper has been a main stream, but since the degree of freedom of the media to be transferred widens, a system of performing transfer with an intermediate transfer medium is extensively used. However, when an intermediate transfer medium is used, similarly to the above case of using a contact charging system, damaging the photoreceptor is liable to occur. For example, various foreign matters present in the image forming apparatus (e.g., metal powders and carrier lumps) get in between the intermediate transfer medium and the photoreceptor or pierce through the photoreceptor. As a result, when the photoreceptor is repeatedly used for a long period of time, pinhole leak as above is caused, so that a generation of image defect is liable to arise.

Concerning the above issues, it is proposed to provide a protective layer on the surface of an electrophotographic photoreceptor to heighten the mechanical strength.

Since an electrophotographic photoreceptor provided with a crosslinked resin layer, as a protective layer, having an charge transporting property has high strength and a rectifying property, blurring of image is restrained and stable images can be obtained for a long period of time, on the other hand a charge transporting property is controlled by the polar groups at crosslinking terminals, so that residual potential is liable to occur, and the thickness of the protective layer of about 2 to 3 μm is generally used. However, with the thickness of from 2 to 3 μm, duration of life can be lengthened as compared with existing electrophotographic photoreceptors not having a protective layer, but it is not said to be sufficient, and thickening of the protective layer is desired for further lengthening duration of life.

On the other hand, thickening of the protective layer results in the increase of residual potential in the photoreceptor. Since charge is accumulated in the photoreceptor and the accumulated quantity is different between the image exposed area and the unexposed area, the residual potential causes unevenness in electrostatic charge between the image exposed area and the unexposed area at the time of charging in the next cycle, as a result the so-called image ghost, that is, a phenomenon that the previous image pattern remains in the next image pattern, is liable to occur. This phenomenon is liable to occur as the thickness of the surface layer increases, in particular very liable to occur when the thickness is 2 μm or more. Further, in the case of color process using a plurality of toners different in colors, electric field of transfer differs according to the thickness of a toner layer, what is called transfer ghost due to image pattern in transfer is liable to occur, and this is an especially serious issue in obtaining high quality color images.

Further, in recent years, the so-called polymerization toners having a uniform particle size have been used for achieving higher image quality. However, the shapes of polymerization toners are approaching spherical as compared with pulverized toners, and in many cases it is necessary to heighten the electric field of transfer as compared with pulverized toners, so that transfer ghost is liable to occur still more. Further, toners nearer to spherical are small in rolling resistance and easily pass through cleaning members such as cleaning blades, so that cleaning failure is liable to be generated. In many cases the pressure of pressing of cleaning blades is set high as compared with the case of pulverized toners for preventing passing through, but as described above, when the blades are closely pressed against the electrophotographic photoreceptor, the friction with the photoreceptor increases, which accelerates abrasion of the photoreceptor and duration of life is liable to shorten.

SUMMARY

According to an aspect of the invention, there is provided an image forming apparatus comprising:

an electrophotographic photoreceptor comprising a conductive support and a photosensitive layer including an outermost surface layer capable of transporting a charge, the outermost surface layer being farthest from the conductive support and containing a resin having a crosslinking structure;

a charging unit that charges the electrophotographic photoreceptor;

a first exposure unit that exposes the electrophotographic photoreceptor to form an electrostatic latent image on the electrophotographic photoreceptor charged;

a developing unit that develop the electrostatic latent image with a toner to form a toner image;

a transfer unit that transfer the toner image from the electrophotographic photoreceptor to a medium to be transferred; and a second exposure unit that uniformly expose the electrophotographic photoreceptor, the outermost surface layer of the electrophotographic photoreceptor absorbing exposure light of the second exposure unit and having a maximum absorbance of about 0.05 or less in the entire wavelength range of the exposure light of the second exposure unit.

BRIEF DESCRIPTION OF THE DRAWINGS

Embodiments of the present invention will be described in detail based on the following figures, wherein:

FIG. 8A shows evaluation A, FIG. B shows evaluation B, and FIG. C shows evaluation.

DETAILED DESCRIPTION

Figure 1:
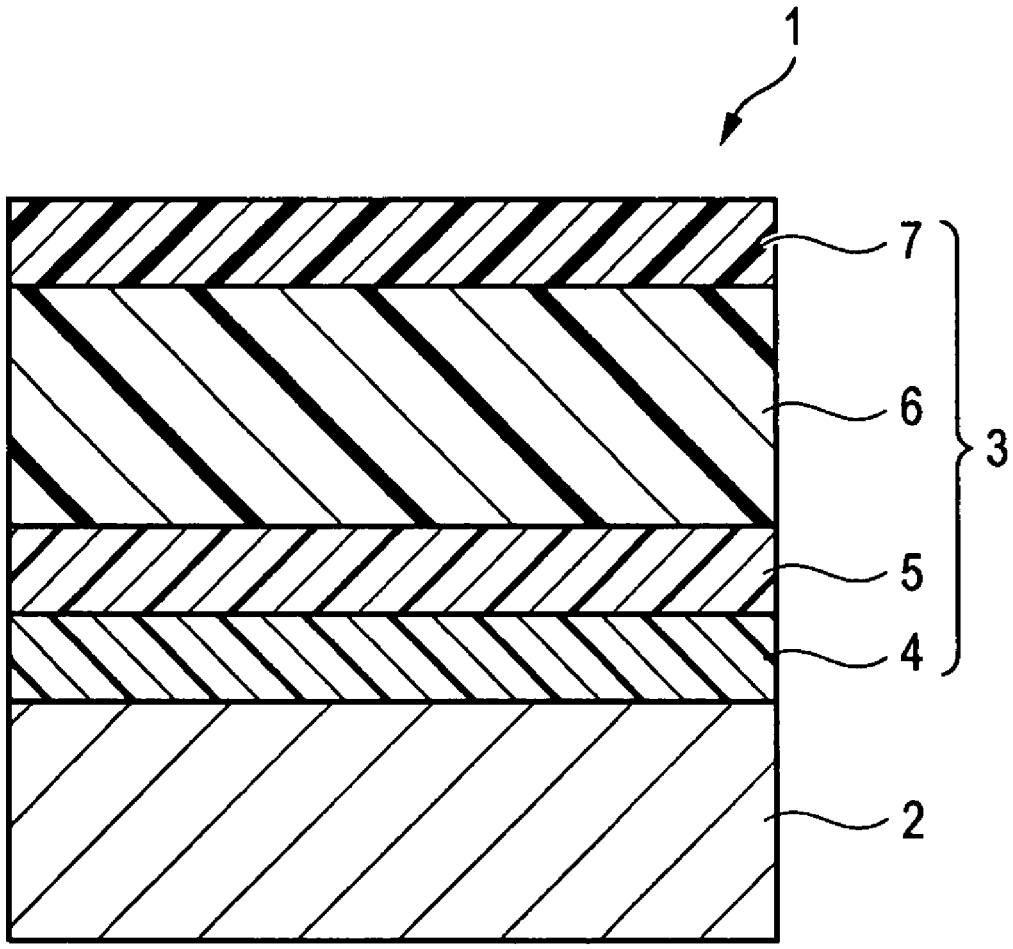
FIG. 1 is a cross-sectional view showing an exemplary embodiment of an electrophotographic photoreceptor for use in an image forming apparatus in the invention.

Exemplary embodiments of the invention will be described in detail below with reference to the accompanying drawings. In the drawings, the same mark is affixed to the same or corresponding element and duplicating explanation is omitted.

Electrophotographic Photoreceptor:

FIG. 1 is a cross-sectional drawing showing a exemplary embodiment of an electrophotographic photoreceptor for use in the image forming apparatus in the invention. Electrophotographic photoreceptor 1 shown in FIG. 1 includes a conductive support 2 and a photosensitive layer 3. The photosensitive layer 3 has a structure comprising an under layer 4, a charge generating layer 5, a charge transporting layer 6 and a protective layer 7 stacked in this order. In the electrophotographic photoreceptor 1 shown in FIG. 1, the protective layer 7 is a charge transporting-outermost surface layer (i.e., an outermost surface layer capable of transporting a charge) containing resin having a crosslinking structure, the outer surface layer being arranged on the farthest side from the conductive support 2.

Figure 2:
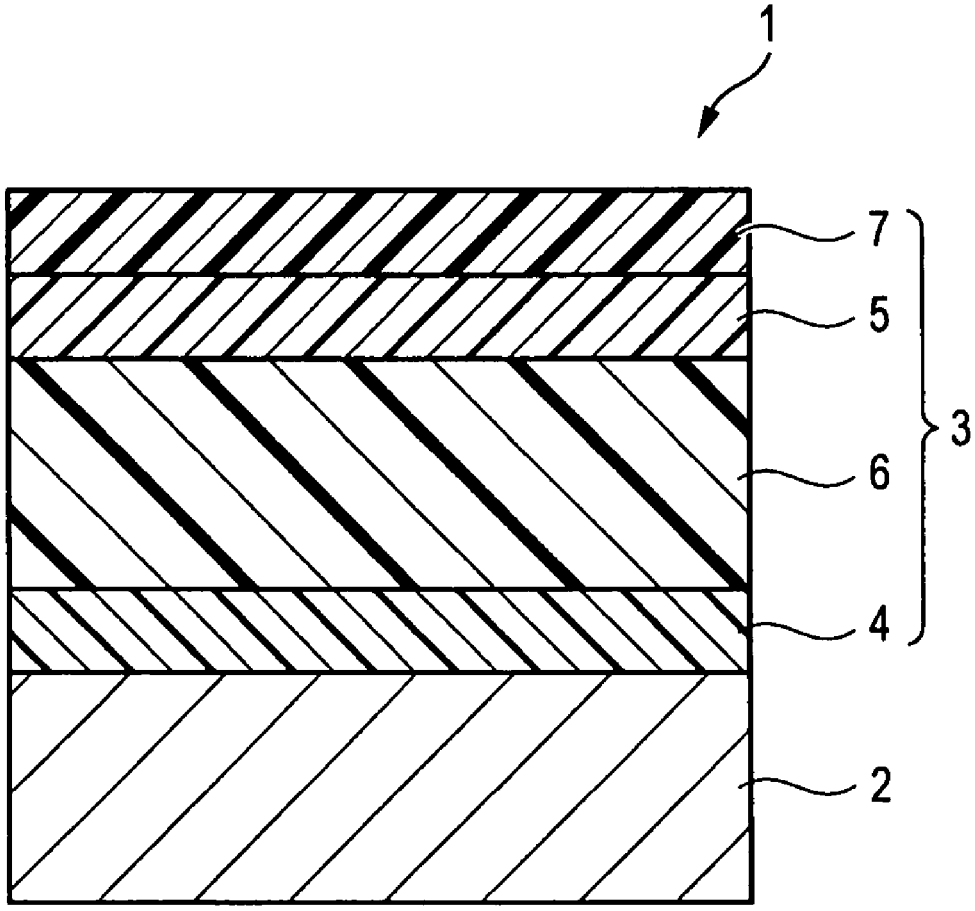
FIG. 2 is a cross-sectional view showing another exemplary embodiment of an electrophotographic photoreceptor for use in an image forming apparatus in the invention.
Figure 3:
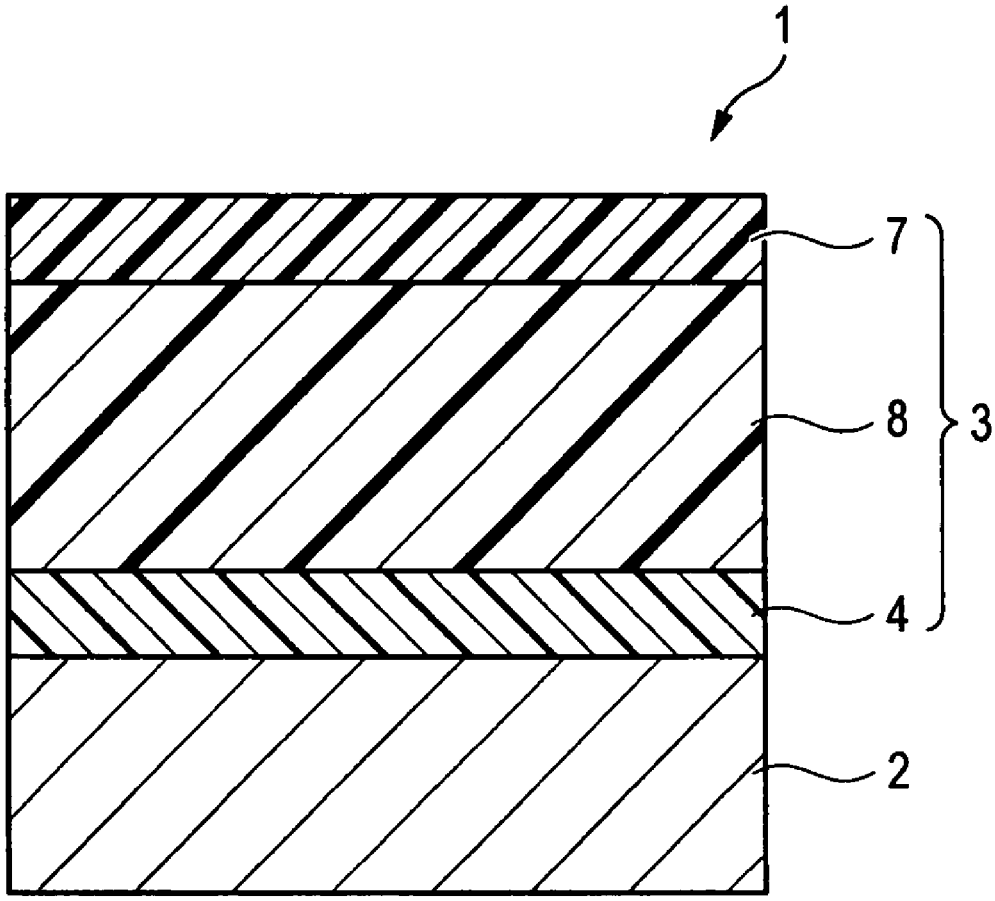
FIG. 3 is a cross-sectional view showing still another exemplary embodiment of an electrophotographic photoreceptor for use in an image forming apparatus in the invention.

FIGS. 2 and 3 each are cross-sectional drawings showing other exemplary embodiments of electrophotographic photoreceptors for use in the image forming apparatus in the invention. The electrophotographic photoreceptor 1 shown in FIG. 2 has a structure comprising a conductive support 2, an under layer 4, a charge transporting layer 6, a charge generating layer 5, and a protective layer 7 stacked in this order. The electrophotographic photoreceptor 1 shown in FIG. 3 has a structure comprising a conductive support 2, an under layer 4, a monolayer type photosensitive layer 8 containing a charge generating material and a charge transporting material, and a protective layer 7 stacked in this order. In the electrophotographic photoreceptors 1 shown in FIGS. 2 and 3, protective layers 7 are also the outermost surface layers.

As described above, the photosensitive layer 3 in the electrophotographic photoreceptor 1 may be the monolayer type photosensitive layer 8 containing a charge generating material and a charge transporting material in one and the same layer, or may be a function-separating type photosensitive layer comprising a layer containing a charge generating material (the charge generating layer 5) and a layer containing a charge transporting material (the charge transporting layer 6) separately. In the case of the function-separating type photosensitive layer, either charge generating layer 5 or charge transporting layer 6 may be stacked as the upper layer. Incidentally, in the case of the function-separating type photosensitive layer, since functions can be separated so that each layer is sufficient to satisfy each function, higher functions can be realized. Further, in the electrophotographic photoreceptors shown in FIGS. 1 to 3, the under layer 4 may not be provided. Further, in the electrophotographic photoreceptors shown in FIGS. 1 and 3, the protective layer 7 may not be provided. When the protective layer 7 is not provided, the charge transporting layer 6 in the electrophotographic photoreceptor 1 in FIG. 1 and the monolayer type photosensitive layer 8 in the electrophotographic photoreceptor 1 in FIG. 3 each are the charge transporting-outermost surface layers containing a resin having a crosslinking structure.

Each element is described below on the basis of the electrophotographic photoreceptor 1 in FIG. 1 as its exemplary embodiment.

As the conductive support 2, a metal plate, a metal drum and a metal belt, which are composed of metals or alloys, e.g., aluminum, copper, zinc, stainless steel, chromium, nickel, molybdenum, vanadium, indium, gold, platinum, etc., are exemplified. Further, as the conductive support 2, paper, a plastic film, a belt, etc., coated, deposited or laminated with conductive compounds such as conductive polymer, indium oxide, etc., metals or alloys, e.g., aluminum, palladium, gold, etc., can also be used.

When the electrophotographic photoreceptor 1 is used in a laser printer, the surface of the conductive support 2 may be subjected to roughening treatment so that the surface has a center line average roughness Ra of from about 0.04 to 0.5 μm, for preventing interference fringes from occurring in laser beam irradiation. When Ra of the surface of the conductive support 2 is less than about 0.04 μm, the surface is close to a specular face, and the effect to prevent interference is liable to be insufficient. While when Ra is greater than 0.5 μm, the image quality is liable to be insufficient even if a film is formed. Further, when noninterference light is used as the light source, roughening treatment to prevent interference fringes is not especially necessary, and generation of defects due to unevenness of the surface of the conductive support 2 can be prevented, which is further suitable for lengthening of duration of life.

As the methods of roughening treatment, wet honing of spraying a suspension of abrasive in water to a support, and centerless grinding of continuously performing grinding by pressing a support against a rotating grinder, and anodizing treatment may be used.

As other roughening method, a method of dispersing conductive or semiconductive powder in resin, forming a layer on the surface of a support, and roughening the surface by the fine particles dispersed in the layer without roughening the surface of the conductive support 2 may also be used.

The anodizing treatment is a method to form an oxide film on the surface of aluminum by anodization in an electrolytic solution with the aluminum as an anode. As the electrolytic solutions, a sulfuric acid solution and an oxalic acid solution are exemplified. However, a porous anodic oxide film formed by anodization is chemically active if it is left intact and liable to be contaminated, and fluctuation of resistance by the environment is also large. Therefore, the anodic oxide film is subjected to sealing treatment, e.g., fine pores are filled with steam under pressure or by volume expansion by hydration in boiling water (metal salt of nickel and the like may be added) to change the oxide film to more stable oxide hydrate.

The thickness of an anodic oxide film is preferably from about 0.3 to 15 μm. When the thickness is less than about 0.3 μm, the film is poor in a barrier property to electric carrier injection and the effect is liable to be insufficient. On the other hand, when the thickness is more than about 15 μm, residual potential is liable to increase by repeating use.

Electrically the conductive support 2 may be subjected to treatment with an acid aqueous solution or boehmite treatment. The treatment with acid aqueous solutions including phosphoric acid, chromic acid or hydrofluoric acid is carried out as follows. In the first place, an acid treating solution is prepared. The proportion of phosphoric acid, chromic acid and hydrofluoric acid in the acid treating solution is such that the range of phosphoric acid is from about 10 to 11 weight %, the range of chromic acid is from about 3 to 5 weight %, and the range of hydrofluoric acid is from about 0.5 to 2 weight %, and the concentration of these acid as a whole is preferably the range of from about 13.5 to 18 weight %. The treating temperature is preferably from about 42 to 48° C. By maintaining the treating temperature high, forming of a thicker film can be expedited. The film thickness of the film is preferably from about 0.3 to 15 μm. When the thickness is less than about 0.3 μm, the film is poor in a barrier property to injection and the effect is liable to be insufficient. On the other hand, when the thickness is more than about 15 μm, residual potential is liable to increase by repeating use.

The boehmite treatment can be performed by immersion of conductive support 2 in pure water at 90 to 100° C. for 5 to 60 minutes, or contact with heated steam of from 90 to 120° C. for 5 to 60 minutes. The film thickness is preferably from 0.1 to 15 μm. The support may further be subjected to anodizing treatment with an electrolytic solution low in film solubility such as adipic acid, boric acid, borate, phosphate, phthalate, maleate, benzoate, tartrate, citrate and the like.

The under layer 4 may be formed on the conductive support 2. The under layer 4, for example, includes binder resin containing inorganic particles.

As the inorganic particles, inorganic particles having powder resistance (volume resistivity) of from about $1\times10^{2}$ Ω·cm to $1\times10^{11}$ Ω·cm or so are preferably used. This is for the reason that it is necessary for the under layer 4 to obtain appropriate resistance to acquire leak resistance and a carrier blocking property. Incidentally, when the powder resistance of the inorganic particles is less than the lower limit, sufficient leak resistance cannot be obtained, while when it exceeds the upper limit, there is the possibility of causing an increase in residual potential.

As the inorganic particles having the above resisting value, inorganic particles such as tin oxide, titanium oxide, zinc oxide, zirconium oxide and the like may be used, and zinc oxide is preferably used.

These inorganic particles may be surface treated, and two or more kinds of inorganic particles subjected to different surface treatments and having different particle sizes can be used as blending.

Inorganic particles having a specific surface area of about 10 $m^2/g$ or more by BET method may be used. When the value of specific surface area is less than about 10 $m^2/g$, reduction of charging property is liable to occur and it is difficult to obtain good electrophotographic characteristics.

By containing an acceptor compound together with inorganic particles, long term stability of electric characteristics and a carrier blocking property of the under layer 4 can be made more excellent. As the acceptor compounds, any compounds can be used so long as the desired characteristics can be obtained, and electron carrying materials such as quinone compounds, e.g., chloranil, bromoanil, etc., tetracyanoquinodimethane compounds, fluorenone compounds, e.g., 2,4,7-trinitrofluorenone, 2,4,5,7-tetranitro-9-fluorenone, etc., oxadiazole compounds, e.g., 2-(4-biphenyl)-5-(4-t-butylphenyl)-1,3,4-oxadiazole, 2,5-bis(4-naphthyl)-1,3,4-oxadiazole, 2,5-bis-(4-diethylaminophenyl)-1,3,4-oxadiazole, etc., xanthone compounds, thiophene compounds, diphenoquinone compounds, e.g., 3,3',5,5'-tetra-t-butyldiphenoquinone, etc., are exemplified, and compounds having an anthraquinone structure are preferred. As the compounds having an anthraquinone structure, hydroxyanthraquinone compounds, aminoanthraquinone compounds, aminohydroxyanthraquinone compounds, etc., may be used, and specifically, anthraquinone, alizarin, quinizarin, anthrarufin, purpurin, etc., are exemplified.

The content of these acceptor compounds in the under layer 4 can be arbitrarily set within the range of capable of obtaining the desired characteristics, but in view of the preventions of accumulation of charge and flocculation of inorganic particles, the content is preferably from about 0.01 to 20 parts by weight per 100 parts by weight of the inorganic particles, and more preferably from about 0.05 to 10 parts by weight. The flocculation of inorganic particles not only results in unevenness of formation of conductive routes and degradation of maintenance such as increase in the residual potential in repeating use, but also image defects such as black spots are liable to occur.

An acceptor compound may be only added at the time of formation of the under layer 4 (coating time), or may be adhered to the surfaces of inorganic particles in advance. As a method of adhering an acceptor compound to the surfaces of inorganic particles, a dry method and a wet method are exemplified.

In the case where the surfaces of inorganic particles are subjected to surface treatment with an acceptor compound by the dry method, while stirring the inorganic particles in a mixer having great shear force, the acceptor compound is dropped directly or in the state of being dissolved in an organic solvent and sprayed with dry air and nitrogen gas, whereby uniform surface treatment can be performed. The addition or spraying of the acceptor compound is preferably performed at not higher than the boiling point of the solvent. When the acceptor compound is sprayed at a temperature higher than the boiling point of the solvent, the solvent is evaporated before the acceptor compound and the solvent are uniformly stirred, and the acceptor compound locally sets and uniform treatment is difficult and not preferred. After the addition or spraying of the acceptor compound, baking can further be performed at about 100° C. or higher. Baking can be done within arbitrary ranges of temperature and time so long as the desired electrophotographic characteristics can be obtained.

In the case where the surfaces of inorganic particles are subjected to surface treatment with an acceptor compound by the wet method, the inorganic particles are stirred in a solvent, dispersed with ultrasonic waves, a sand mill, an attritor, a ball mill or the like, the acceptor compound is added, stirred or dispersed, and then the solvent is removed, whereby uniform treatment can be performed. For removing the solvent, a method of removal by filtration or distillation is exemplified. After removing the solvent, baking can further be performed at about 100° C. or higher. Baking can be done within arbitrary ranges of temperature and time so long as the desired electrophotographic characteristics can be obtained. In the wet method, the moisture contained in inorganic particles can be removed before the addition of a surface treating agent, e.g., a method of removal by stirring with heating the inorganic particles in the solvent used for surface treatment, and a method of removal by azeotropy with the solvent can be used.

Before the adhesion of an acceptor compound, inorganic particles can be subjected to another surface treatment. As the surface treating agents, any compound can be used so long as the desired characteristics can be obtained, and they can be selected from among various known compounds. As the surface treating agents, e.g., a silane coupling agent, a titanate coupling agent, an aluminum coupling agent, a surfactant and the like can be exemplified. Since a good electrophotographic characteristics can be obtained, a silane coupling agent may be used. Further, a silane coupling agent having an amino group may be used for capable of imparting a good blocking property to the under layer 4.

As the silane coupling agent having an amino group, any compound can be used so long as the desired characteristics of an electrophotographic photoreceptor can be obtained. Specifically, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, etc., are exemplified. The silane coupling agents having an amino group are not restricted thereto.

Two or more silane coupling agents may be used as blending. Silane coupling agents that can be used in combination with the silane coupling agents having an amino group are not especially restricted and, e.g., vinyltrimethoxysilane, γ-methacryloxypropyl-tris(β-methoxyethoxy)silane, β-(3,4-epoxycyclohexyl)ethyltrimethoxysilane, γ-glycidoxypropyl-trimethoxysilane, vinyltriacetoxysilane, γ-mercaptopropyltrimethoxysilane, γ-aminopropyltriethoxysilane, N-β-(amino-ethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, γ-chloropropyltrimethoxysilane, etc., are exemplified.

Any of known surface treatment methods can be used, and a dry method and a wet method can be used. Surface treatment with an acceptor compound and a coupling agent may be carried out at the same time.

The amount of a silane coupling agent to the inorganic particles in the under layer 4 can be arbitrarily set so long as the desired electrophotographic characteristics can be obtained, but the amount of from about 0.5 to 10 weight parts per 100 weight parts of the inorganic particles is preferred in view of the improvement of dispersibility.

As binder resins contained in the under layer 4, any of known binder resins can be used so long as good films can be formed and the desired characteristics can be obtained. For example, known polymeric compounds such as acetal resins, e.g., polyvinyl butyral, etc., polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, urethane resins, etc., and electrically conductive resins such as charge transporting resins having a charge transporting group, polyaniline, etc., can be used. Of these compounds, resins insoluble in the coating solvent of the upper layer are preferably used, in particular phenolic resins, phenol-formaldehyde resins, melamine resins, urethane resins, and epoxy resins are preferably used. When these resins are used in combination of two or more, the blending ratio can be arbitrarily set according to necessity.

The ratio of the contents of inorganic particles such as metallic oxide particles imparted with an acceptor property and the binder resin, or inorganic particles and the binder resin in the under layer 4 can be arbitrarily determined within the range of capable of obtaining the desired characteristics of an electrophotographic photoreceptor.

Various additives can be used in the under layer 4 for the purpose of the improvements of electrical characteristics, environmental stability and image quality. As such additives, known materials such as polycyclic condensed series and azo series electron transporting pigments, zirconium chelating compounds, titanium chelating compounds, aluminum chelating compounds, titanium alkoxide compounds, organic titanium compounds, silane coupling agents, etc., can be used. Silane coupling agents are used for surface treatment of metallic oxides, but they can be further added as additives.

As the specific examples of silane coupling agents used here include vinyltrimethoxysilane, γ-methacryloxypropyl-tris(β-methoxyethoxy)silane, β-(3,4-epoxycyclohexyl) ethyl-trimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropyl-methylmethoxysilane, N,N-bis(β-hydroxyethyl)-γ-aminopropyl-triethoxysilane, γ-chloropropyltrimethoxysilane, etc. As the examples of the zirconium chelating compounds, zirconium butoxide, zirconium ethyl acetoacetate, zirconium triethanolamine, zirconium acetylacetonate butoxide, zirconium ethylacetoacetate butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide, etc., are exemplified.

As the examples of the titanium chelating compounds, tetraisopropyl titanate, tetra-n-butyl titanate, butyl titanate dimer, tetra(2-ethylhexyl)titanate, titanium acetylacetonate, polytitanium acetylacetonate, titanium octylene glyconate, titanium lactateammonium salt, titanium lactate, titanium lactate ethyl ester, titanium triethanolaminate, polyhydroxy titanium stearate, etc., are exemplified.

As the examples of the aluminum chelating compounds, aluminum isopropylate, monobutoxyaluminum diisopropylate, aluminum butylate, diethylacetoacetatealuminum diisopropylate, aluminum tris(ethylacetoacetate), etc., are exemplified.

These compounds can be used alone, or a plurality of compounds can be used as blending or polycondensed products.

The under layer 4 is formed with a coating solution for forming an under layer containing the described constituting materials. As the solvents for preparing the coating solution for forming an under layer, solvents optionally selected from known organic solvents, e.g., alcohol solvents, aromatic solvents, halogenated hydrocarbon solvents, ketone solvents, ketone alcohol solvents, ether solvents, ester solvents, etc., can be used. More specifically, ordinarily used organic solvents, such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, toluene, etc., can be used.

These solvents used for dispersion can be used alone, or two or more solvents can be used as a mixed solvent. When two or more kinds of solvents are blended, any of the solvents capable of dissolving binder resin as a mixed solvent can be used.

As the methods for dispersion, known methods, e.g., a roll mill, a ball mill, a vibrating mill, an attritor, a sand mill, a colloid mill, and a paint shaker can be used.

The thus obtained coating solution for forming an under layer is coated on the conductive support 2 and dried to remove the solvent, whereby the under layer 4 is formed. As the coating method in forming the under layer 4, ordinary methods, e.g., a blade coating method, a wire bar coating method, a spray coating method, an dip coating method, a bead coating method, an air knife coating method, a curtain coating method, etc., can be used. Drying is generally carried out at a temperature capable of evaporating the solvent and forming a film.

The under layer 4 thus formed preferably has Vickers' hardness of about 35 or more. The thickness of the under layer 4 is not especially restricted so long as the desired characteristics can be obtained, but the thickness is preferably about 15 μm or more, and more preferably from about 15 to 50 μm. When the thickness of the under layer 4 is less than about 15 μm, it is difficult to obtain a sufficient leak resisting property, while when the thickness is higher than about 50 μm, potential is liable to remain in long term use, as a result there is a tendency to cause abnormality in image density.

For the purpose of prevention of a Moiré image, the surface roughness (ten point average surface roughness) of the under layer 4 can be adjusted to ¼n (n is the refractive index of the upper layer) to ½λ of the laser wavelength λ used for exposure. Further, for the adjustment of surface roughness, particles of resins and the like can be added to the under layer 4. As the resin particles, silicone resin particles and crosslinking type PMMA resin particles can be used.

Further, for the adjustment of surface roughness, the under layer 4 can be subjected to polishing. As polishing methods, buffing, sand blast treatment, wet honing, grinding treatment, etc., can be used.

The charge generating layer 5 includes a charge generating material and, if necessary, binder resin.

As the charge generating materials, azo pigments, e.g., bisazo, trisazo, etc., condensed ring aromatic pigments, e.g., dibromoanthoanthrone, etc., perylene pigments, pyrrolo-pyrrole pigments, phthalocyanine pigments, zinc oxide, trigonal selenium, etc., can be exemplified. Of these materials, metal or nonmetal phthalocyanine pigments are preferably used to near infrared laser exposure, and hydroxygallium phthalocyanines disclosed in JP-A-5-263007 and JP-A-5-279591, chlorogallium phthalocyanines disclosed in JP-A-5-98181, dichlorotin phthalocyanines disclosed in JP-A-5-140472 and JP-A-5-140473, and titanyl phthalocyanine disclosed in JP-A-4-189873 and JP-A-5-43823 are preferably used. Further, to the laser exposure in near ultraviolet region, condensed ring aromatic pigments, e.g., dibromoanthoanthrone, thioindigo pigments, porphyrazine compounds, zinc oxide and trigonal selenium are more preferred.

Binder resins for use in the charge generating layer 5 can be selected from the wide range of insulating resins. The binder resins can also be selected from organic photoconductive polymers such as poly-N-vinylcarbazole, polyvinylanthracene, polyvinylpyrene, polysilane, etc. As preferred binder resins, polyvinyl butyral resins, polyallylate resins (polycondensed products of bisphenols and aromatic divalent carboxylic acids), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, polyvinyl pyrrolidone resins, etc., are exemplified. These resins can be used alone, or two or more kinds as blending.

The charge generating layer 5 is formed by deposition of a charge generating material, or by coating of a coating solution for forming a charge generating layer containing a charge generating material and binder resin. When the charge generating layer 5 is formed with a coating solution for forming a charge generating layer, the blending proportion of the charge generating material and the binder resin is preferably in the range of from about 10/1 to 1/10 in weight ratio.

The coating solution for forming a charge generating layer can be prepared by dispersing the charge generating material and the binder resin in a prescribed solvent.

As the solvents used for dispersion, methanol, ethanol, n-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, toluene, etc., are exemplified. These solvents can be used alone, or two or more kinds as blending.

As the method of dispersing a charge generating material and binder resin in a solvent, ordinary methods, e.g., a ball mill dispersing method, an attritor dispersing method and a sand mill dispersing method can be used. According to these dispersing methods, varying of the crystal form of the charge generating material due to dispersion can be prevented. Further, in the dispersing, it is effective to make the average particle size of the charge generating material preferably about 0.5 μm or less, more preferably about 0.3 μm or less, and still more preferably about 0.15 μm or less.

When the charge generating layer 5 is formed with the coating solution for forming a charge generating layer, ordinary methods, e.g., a blade coating method, a wire bar coating method, a spray coating method, an dip coating method, a bead coating method, an air knife coating method, a curtain coating method, etc., can be used.

The film thickness of the thus obtained charge generating layer 5 is preferably from about 0.1 to 5.0 μm, and more preferably from about 0.2 to 2.0 μm.

The charge transporting layer 6 is formed of a charge transporting material and binder resin, or a high molecular charge transporting material.

The examples of charge transporting materials include electron carrying compounds such as quinone compounds, e.g., p-benzoquinone, chloranil, bromoanil, anthraquinone, etc., tetracyanoquinodimethane compounds, fluorenone compounds, e.g., 2,4,7-trinitrofluorenone, etc., xanthone compounds, benzophenone compounds, cyanovinyl compounds, ethylene compounds, etc., and hole carrying compounds such as triarylamine compounds, benzidine compounds, arylalkane compounds, aryl-substituted ethylene-based compounds, stilbene compounds, anthracene compounds, hydrazone compounds, etc. These charge transporting materials can be used alone, or two or more kinds can be used as blending, but the charge transporting materials are not restricted to these compounds.

As charge transporting materials, from the point of mobility, a compound represented by the following formula (a-1) or (a-2) is preferred.

(a-1)

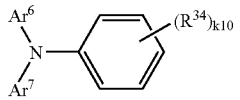

In formula (a-1), $R^{34}$ represents a hydrogen atom or a methyl group; k10 represents 1 or 2; $Ar^6$ and $Ar^7$ each represents a substituted or unsubstituted aryl group, $—C_6H_4—C(R^{38})=C(R^{39})—(R^{40})$, or $—C_6H_4—CH=CH—CH=C(R^{41})(R^{42})$; and $R^{38}$, $R^{39}$, $R^{40}$, $R^{41}$ and $R^{42}$ each independently represents a hydrogen atom, a substituted or unsubstituted alkyl group, or a substituted or unsubstituted aryl group. As the examples of the substitutents, a halogen atom, an alkyl group having from 1 to 5 carbon atoms, an alkoxyl group having from 1 to 5 carbon atoms, and a substituted amino group substituted with an alkyl group having from 1 to 3 carbon atoms are exemplified.

(a-2)

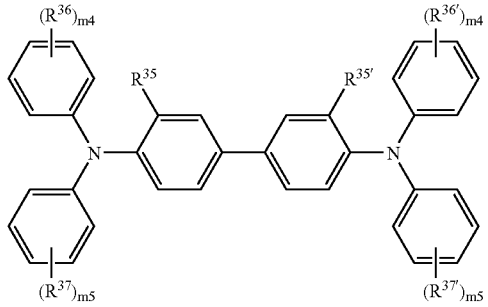

In formula (a-2), $R^{35}$ and $R^{35'}$ each independently represents a hydrogen atom, a halogen atom, an alkyl group having from 1 to 5 carbon atoms, or an alkoxyl group having from 1 to 5 carbon atoms; $R^{36}$, $R^{36'}$, $R^{37}$ and $R^{37'}$ each independently represents a halogen atom, an alkyl group having from 1 to 5 carbon atoms, an alkoxyl group having from 1 to 5 carbon atoms, an amino group substituted with an alkyl group having from 1 or 2 carbon atoms, a substituted or unsubstituted aryl group, $—C(R^{38})=C(R^{39})(R^{40})$, or $—CH=CH—CH=C(R^{41})(R^{42})$; $R^{38}$, $R^{39}$, $R^{40}$, $R^{41}$ and $R^{42}$ each independently represents a hydrogen atom, a substituted or unsubstituted alkyl group, or a substituted or unsubstituted aryl group, and m4 and m5 each represents an integer of from 0 to 2.

Of the above, a triarylamine derivative having $—C_6H_4—CH=CH—CH=C(R^{41})(R^{42}$ and a benzidine derivative having $—CH=CH—CH=C(R^{41})(R^{42})$ are especially preferred for the reasons that they are excellent in electric mobility, adhesion with the protective layer, and inhibition of ghost.

As binder resins for use in the charge transporting layer 6, polycarbonate resin, polyester resin, polyallylate resin, methacrylic resin, acrylic resin, polyvinyl chloride resin, polyvinylidene chloride resin, polystyrene resin, polyvinyl acetal resin, styrene-butadiene copolymer, polyvinylidene chloride-acrylonitrile copolymer, vinyl chloride-vinyl acetate copolymer, vinyl chloride-vinyl acetate-maleic anhydride copolymer, silicone resin, silicone alkyd resin, phenol-formaldehyde resin, styrene-alkyd resin, poly-N-vinylcarbazole, polysilane, etc., are exemplified. Further, high molecular charge transporting materials, e.g., polyester series high molecular charge transporting materials as disclosed in JP-A-8-176293 and JP-A-8-208820 can also be used. These binder resins can be used alone or two or more as blending. The blending ratio of charge transporting materials and binder resins is preferably from about 10/1 to 1/5 in molar ratio.

High molecular charge transporting materials can also be used as the charge transporting material. As the high molecular charge transporting materials, known compounds having a charge transporting property, e.g., poly-N-vinylcarbazole, polysilane, etc., can be used. In particular, high molecular polyester series charge transporting materials disclosed in JP-A-8-176293 and JP-A-8-208820 have a high charge transporting property and especially preferred. High molecular charge transporting materials are capable of forming films by themselves alone, but the binder resin may be blended in forming films.

The charge transporting layer 6 can be formed of a coating solution for forming a charge transporting layer containing the above constituting materials.

As the solvents for use in a coating solution for forming a charge transporting layer, usually used organic solvents such as aromatic hydrocarbons, e.g., benzene, toluene, xylene, chlorobenzene, etc., ketones, e.g., 2-butanone, etc., halogenated aliphatic hydrocarbons, e.g., methylene chloride, chloroform, ethylene chloride, etc., and cyclic or straight chain ethers, e.g., tetrahydrofuran, ethyl ether, etc., can be used alone or in blending of two or more kinds. As the dispersing method of the constituting materials, any of known methods can be used.

For coating the coating solution for forming a charge transporting layer on the charge generating layer 5, ordinary methods such as a blade coating method, a wire bar coating method, a spray coating method, an dip coating method, a bead coating method, an air knife coating method, a curtain coating method, etc., can be used.

The thickness of charge transporting layer 6 is preferably from about 5 to 50 μm, and more preferably from about 10 to 30 μm.

The protective layer 7 is the outermost surface layer of the electrophotographic photoreceptor 1, and this is a layer provided to have resistance to abrasion and scratch of the outermost surface and to increase the transfer efficiency of toners.

The protective layer 7 includes a crosslinked resin layer having a charge transporting property, and as charge transporting materials to give a charge transporting property, those having reactivity may be used. Specifically compounds having the following structures are exemplified.

As the charge transporting materials that can be used in the protective layer 7, for example, the compounds represented by any of the following formulae (I) to (V) can be exemplified. As specific structures, e.g., the following structures are exemplified.

$$F[-(X^1)_{n1}R^1-CO_2H]_{m1} \quad (I)$$

In formula (I), F represents an organic group derived from a compound having a hole transporting property; $R^1$ represents an alkylene group; $X^1$ represents an oxygen atom or a sulfur atom; m1 represents an integer of from 1 to 4; and n1 represents 0 or 1.

$$F[-(X^2)_{n2}-(R^2)_{n3}-(Z^2)_{n4}G]_{n5} \quad (II)$$

In formula (II), F represents an organic group derived from a compound having a hole transporting property; $X^2$ represents an oxygen atom or a sulfur atom; $R^2$ represents an alkylene group; $Z^2$ represents an alkylene group, an oxygen atom, a sulfur atom, NH or COO; G represents a hydrogen atom, an epoxy group, an acryl group, a methacryl group, or a monovalent group having an alkoxyxilyl group; n2, n3 and n4 each represents 0 or 1; and n5 represents an integer of from 1 to 4.

(III)

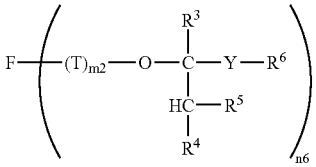

In formula (III), F represents an organic group derived from a compound having a hole transporting property; T represents a divalent group; Y represents an oxygen atom or a sulfur atom; $R^3$, $R^4$ and $R^5$ each independently represents a hydrogen atom or a monovalent organic group; $R^6$ represents a monovalent organic group; m2 represents 0 or 1; and n6 represents an integer of from 1 to 4, provided that $R^5$ and $R^6$ may be bonded to each other to form a heterocyclic ring with Y as the hetero atom.

(IV)

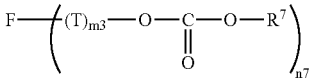

In formula (IV), F represents an organic group derived from a compound having a hole transporting property; T represents a divalent linking group; $R^7$ represents a monovalent organic group; m3 represents 0 or 1; and n7 represents an integer of from 1 to 4.

$$F-(L-O-R^8)_{n8} \quad (V)$$

In formula (V), F represents an organic group derived from a compound having a hole transporting property; $R^8$ represents a monovalent organic group; L represents an alkylene group; and n8 represents an integer of from 1 to 4.

By containing the resin obtained with these compounds in the surface layer of an electrophotographic photoreceptor, the electrophotographic characteristics, methanical strength, and electric characteristics of the electrophotographic photoreceptor can be further heightened. Further, F in the compound represented by any of the above formulae (I) to (V) is preferably a group represented by the following formula (VI).

(VI)

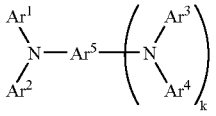

In formula (VI), $Ar^1$, $Ar^2$, $Ar^3$ and $Ar^4$ each independently represents a substituted or unsubstituted aryl group; $Ar^5$ represents a substituted or unsubstituted aryl group or arylene group, provided that from 1 to 4 of $Ar^1$ to $Ar^5$ represent a bonding hand to bond to the site represented by formula (VII) below in the compound represented by formula (I) above, the site represented by formula (VIII) below in the compound represented by formula (II) above, the site represented by formula (IX) below in the compound represented by formula (III) above, the site represented by formula (X) below in the compound represented by formula (IV) above, or the site represented by formula (XI) below in the compound represented by formula (V) above; and k represents 0 or 1.

$$-(X^1)_{n1}R^1-CO_2H \quad (VII)$$

$$-(X^2)_{n2}-(R^2)_{n3}-(Z^2)_{n4}G \quad (VIII)$$

(IX)

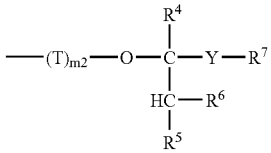

(X)

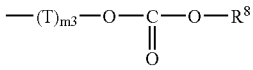

$$-L-O-R^8 \quad (XI)$$

As the substituted or unsubstituted aryl groups represented by $Ar^1$ to $Ar^4$ in formula (VI), specifically the aryl groups represented by any of the following formulae (1) to (7) are preferred.

TABLE 1

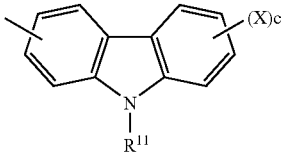

(1)

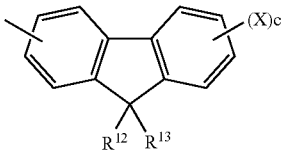

(2)

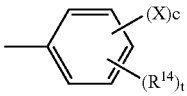

(3)

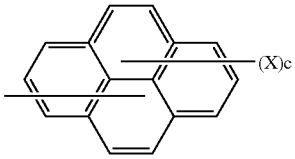

(4)

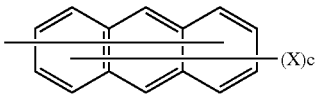

(5)

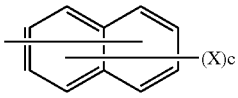

(6)

—Ar—(Z')s-Ar—(X)c (7)

In formulae (1) to (7) above, $R^{11}$ represents a hydrogen atom, an alkyl group having from 1 to 4 carbon atoms, an alkoxyl group having from 1 to 4 carbon atoms, a phenyl group substituted with any of these groups, an unsubstituted phenyl group, or an aralkyl group having from 7 to 10 carbon atoms; $R^{12}$, $R^{13}$ and $R^{14}$ each independently represents a hydrogen atom, an alkyl group having from 1 to 4 carbon atoms, an alkoxyl group having from 1 to 4 carbon atoms, a phenyl group substituted with any of these groups, an unsubstituted phenyl group, an aralkyl group having from 7 to 10 carbon atoms, or a halogen atom; Ar represents a substituted or unsubstituted arylene group; X represents any of the structures represented by above formulae (VII) to (XI); c and s each represents 0 or 1; and t represents an integer of from 1 to 3.

Ar in the aryl group represented by formula (7) is preferably an arylene group represented by the following formula (8) or (9).

TABLE 2

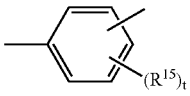

(8)

TABLE 2-continued

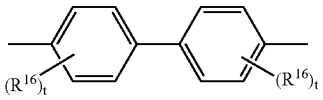

(9)

In formulae (8) and (9) above, $R^{15}$ and $R^{16}$ each independently represents a hydrogen atom, an alkyl group having from 1 to 4 carbon atoms, an alkoxyl group having from 1 to 4 carbon atoms, a phenyl group substituted with an alkoxyl group having from 1 to 4 carbon atoms, an unsubstituted phenyl group, an aralkyl group having from 7 to 10 carbon atoms, or a halogen atom; and t represents an integer of from 1 to 3.

Z' in the aryl group represented by formula (7) is preferably a divalent linking group represented by any of the following formulae (10) to (17).

TABLE 3

$—(CH_2)_q—$ (10)

$—(CH_2CH_2O)_r—$ (11)

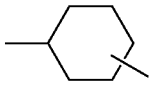

(12)

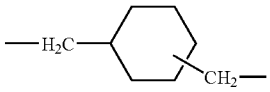

(13)

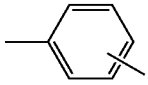

(14)

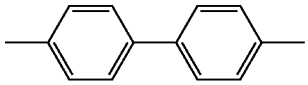

(15)

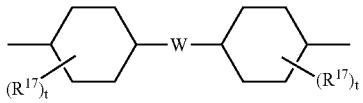

(16)

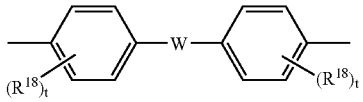

(17)

In formulae (10) to (17) above, $R^{17}$ and $R^{18}$ each independently represents a hydrogen atom, an alkyl group having from 1 to 4 carbon atoms, an alkoxyl group having from 1 to 4 carbon atoms, a phenyl group substituted with an alkoxyl group having from 1 to 4 carbon atoms, an unsubstituted phenyl group, an aralkyl group having from 7 to 10 carbon atoms, or a halogen atom; W represents a divalent group; q and r each represents an integer of from 1 to 10; and t represents an integer of from 1 to 3.

In the above formulae (16) and (17), W represents a divalent group represented by any of the following formulae (18) to (26); incidentally U in formula (25) represents an integer of from 0 to 3.

TABLE 4

| | |
|---|---|
| —$CH_2$— | (18) |
| —$C(CH_3)_2$— | (19) |
| —O— | (20) |
| —S— | (21) |
| —$C(CF_3)_2$— | (22) |
| —$Si(CH_3)_2$— | (23) |
| 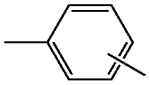 | (24) |
| 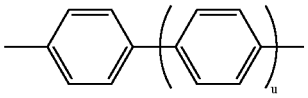 | (25) |
| 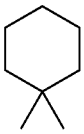 | (26) |

In formula (VI), $Ar^5$ is the aryl group exemplified in the explanation of $Ar^1$ to $Ar^4$ when k represents 0, and when k represents 1, $Ar^5$ is the arylene group obtained by eliminating the prescribed hydrogen atom(s).

As the specific examples of the compounds represented by formula (I), the following shown compounds (I-1) to (I-8) are exemplified. The compounds represented by formula (I) are by no means restricted to these compounds. Further, in the following table, those in which bonding hands are described but substitutents are not shown are methyl groups.

TABLE 5

I-1

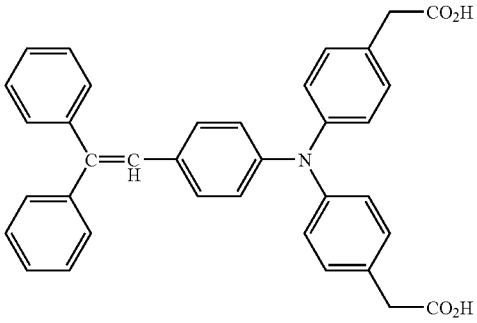

I-2

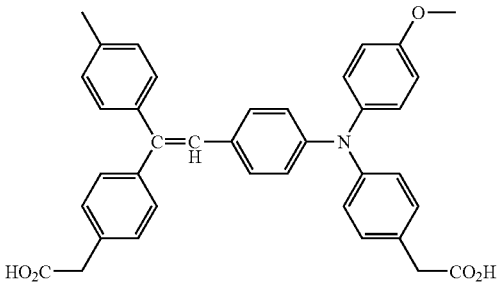

TABLE 5-continued

I-3

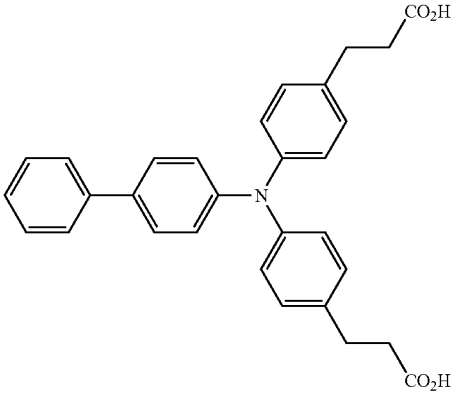

I-4

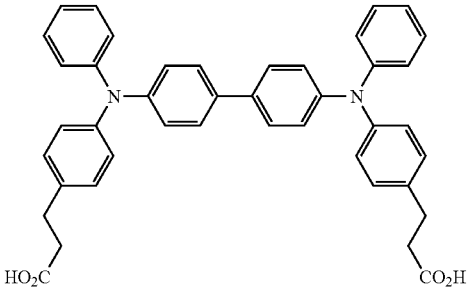

I-5

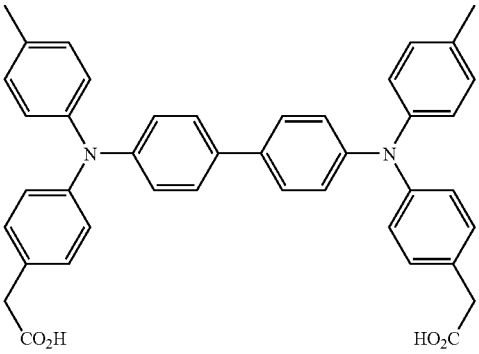

I-6

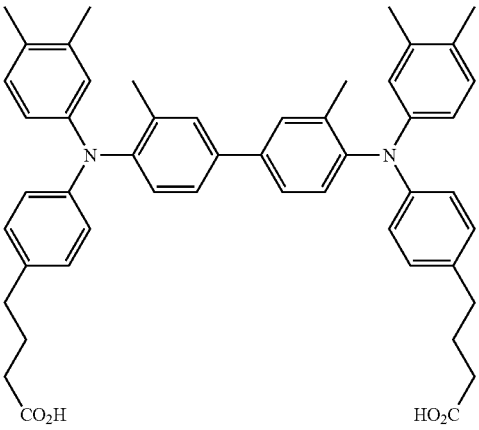

TABLE 5-continued

I-7

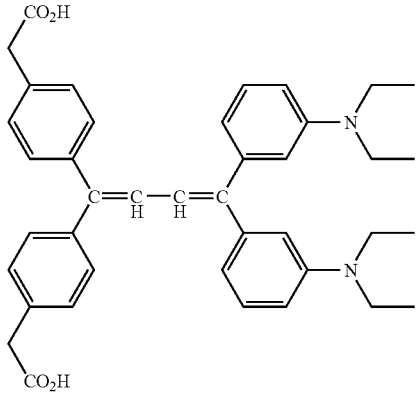

I-8

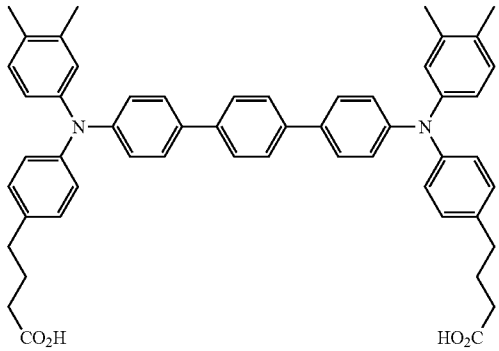

As the specific examples of the compounds represented by formula (II), the following shown compounds (II-1) to (II-17) are exemplified. The compounds represented by formula (II) are by no means restricted to these compounds. Further, in the following table, those in which Me or bonding hands are described but substitutents are not shown are methyl groups, and Et represents an ethyl group.

TABLE 6

II-1

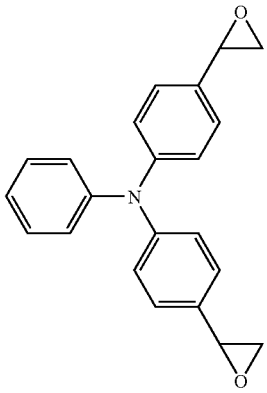

TABLE 6-continued

II-2

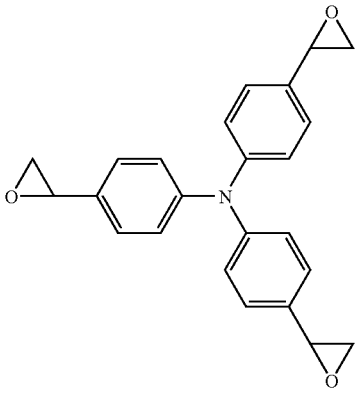

II-3

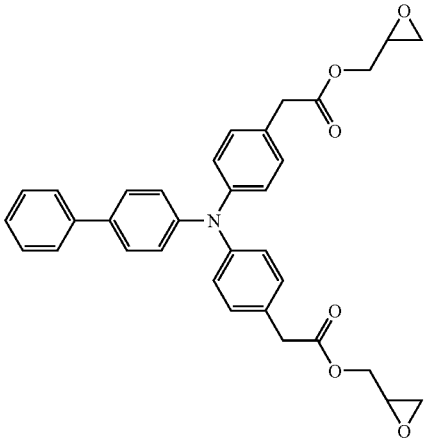

II-4

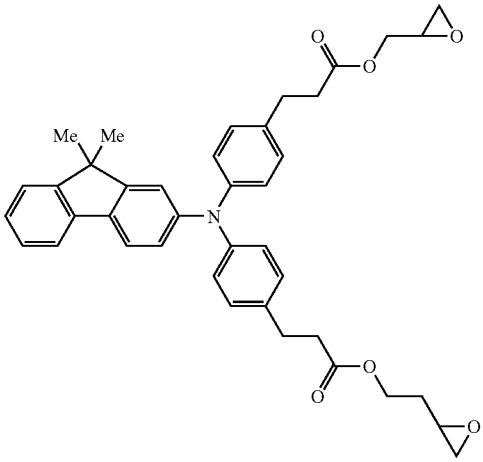

TABLE 6-continued
II-5
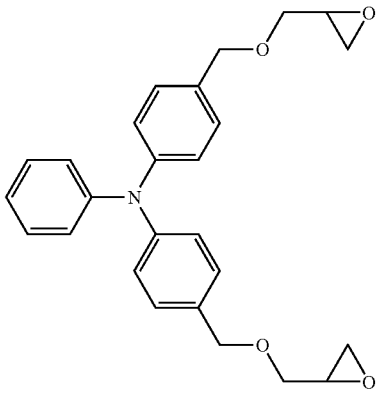
II-6
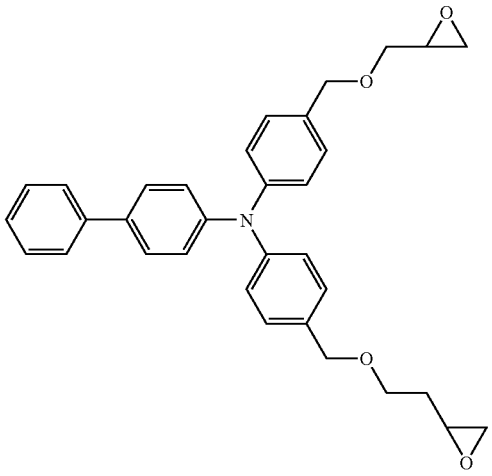
TABLE 7
II-7
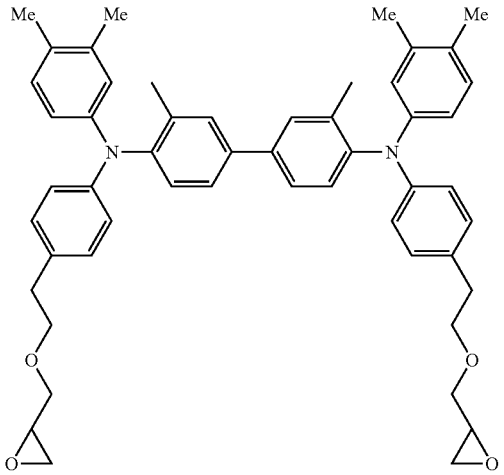
TABLE 7-continued
II-8
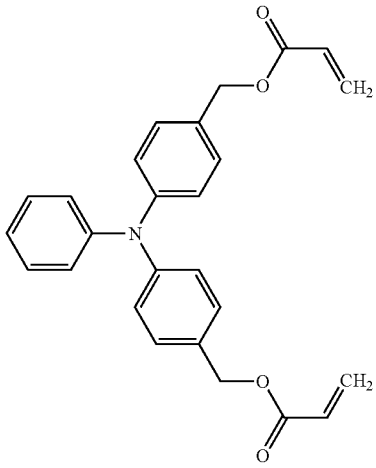
II-9
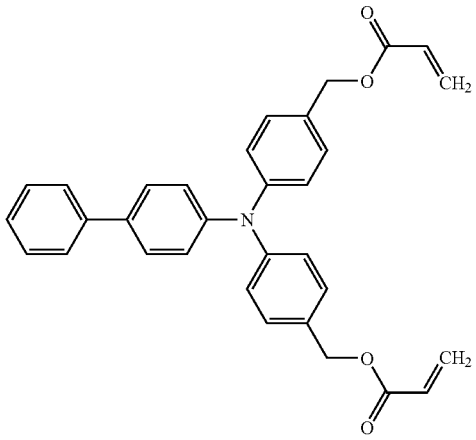
II-10
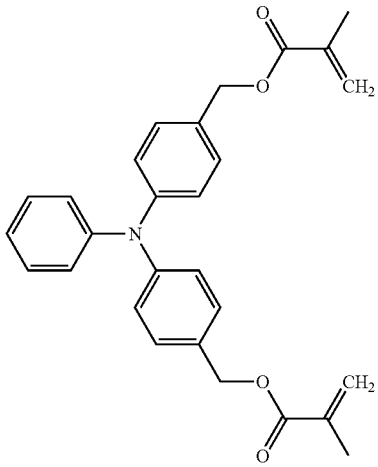

TABLE 7-continued
II-11
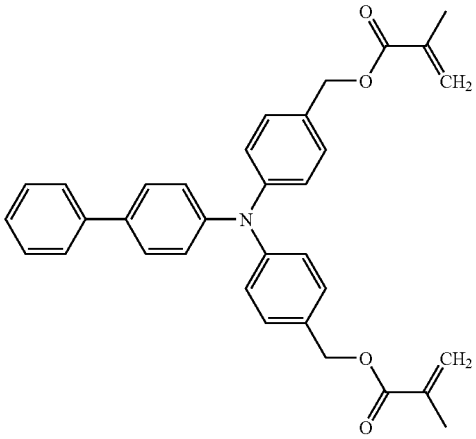
II-12
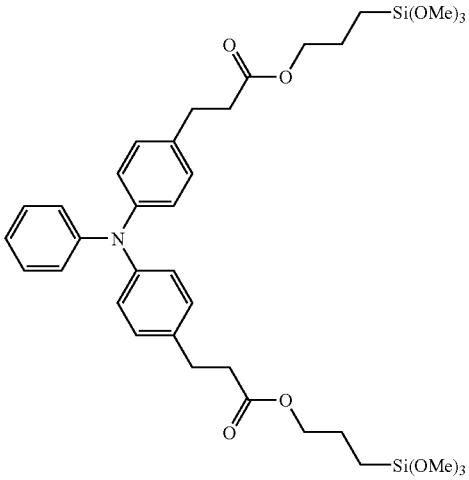
TABLE 8
II-13
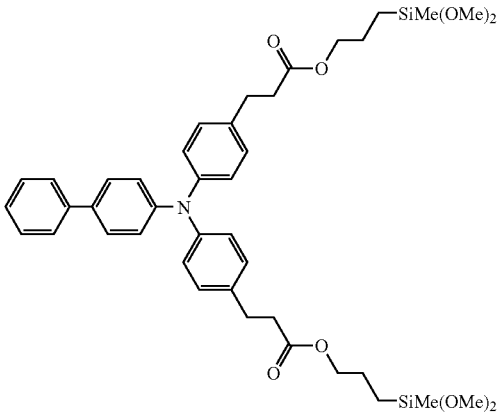
TABLE 8-continued
II-14
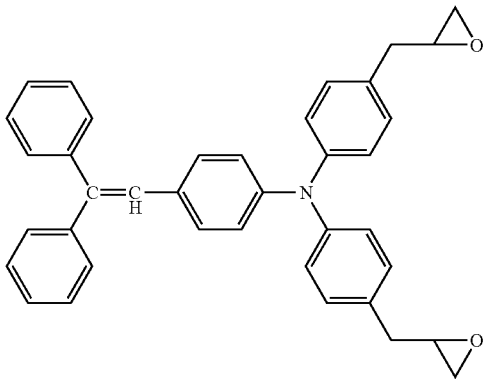
II-15
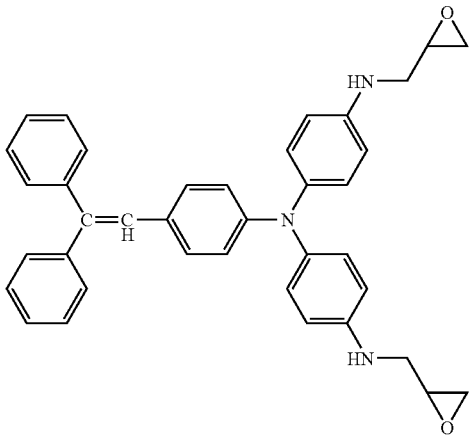
II-16
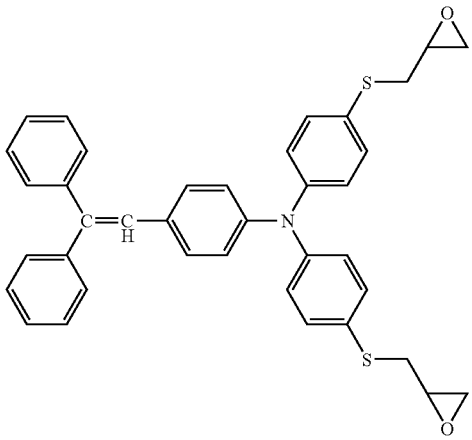

TABLE 8-continued

II-17

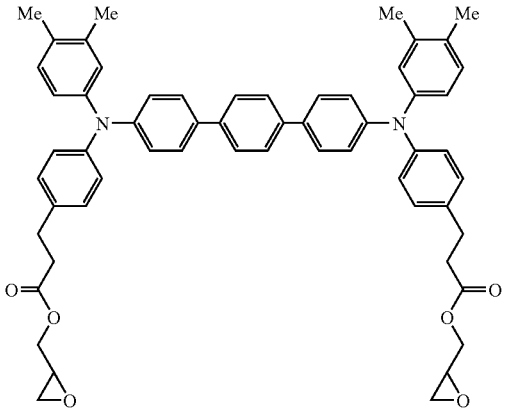

As the specific examples of the compounds represented by formula (III), the following shown compounds (III-1) to (III-18) are exemplified. The compounds represented by formula (III) are by no means restricted to these compounds. Further, in the following table, those in which Me or bonding hands are described but substitutents are not shown are methyl groups, and Et represents an ethyl group.

TABLE 9

III-1

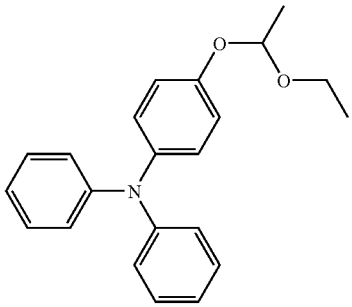

III-2

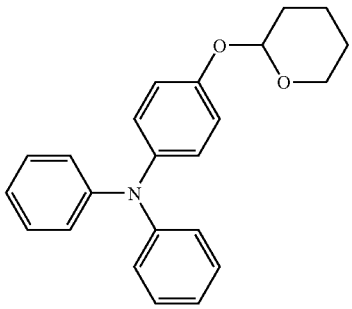

TABLE 9-continued

III-3

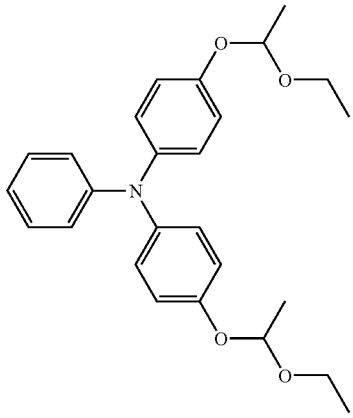

III-4

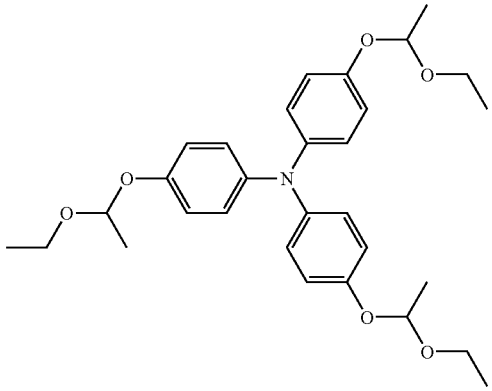

III-5

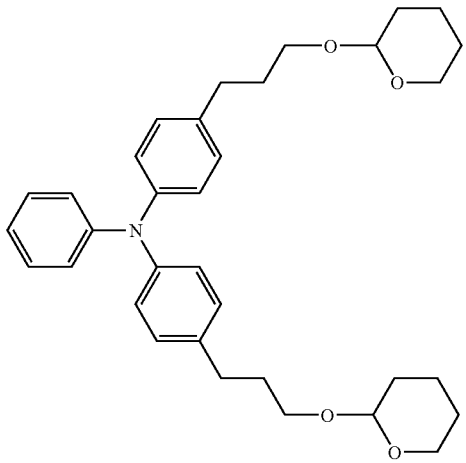

TABLE 9-continued
III-6
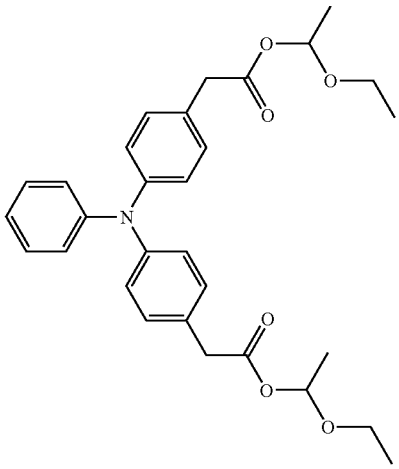
TABLE 10
III-7
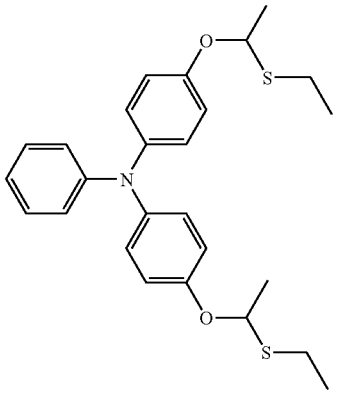
III-8
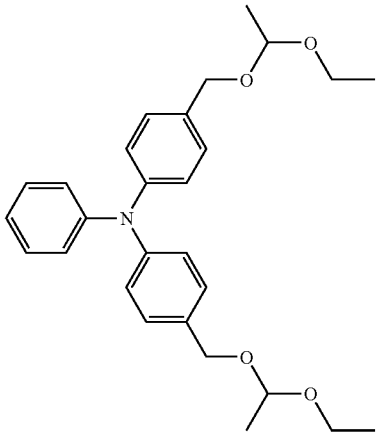
TABLE 10-continued
III-9
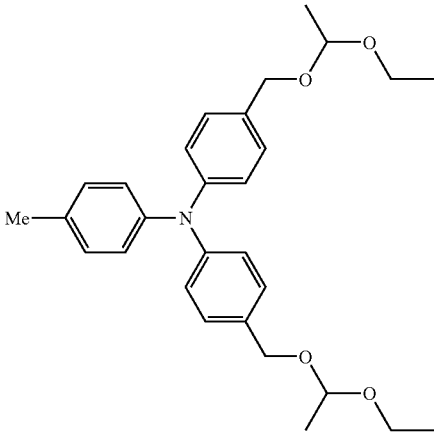
III-10
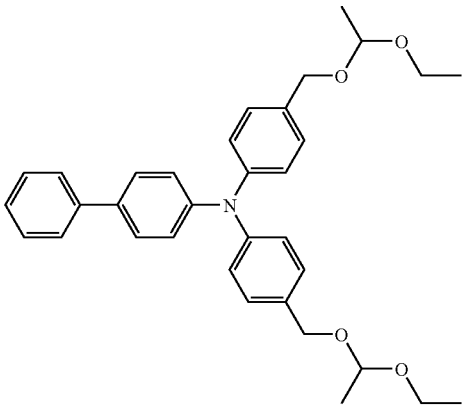
III-11
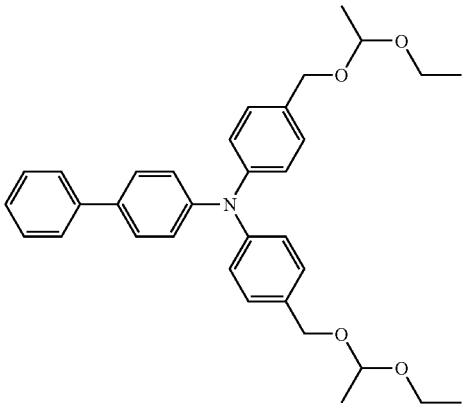

TABLE 10-continued

III-12

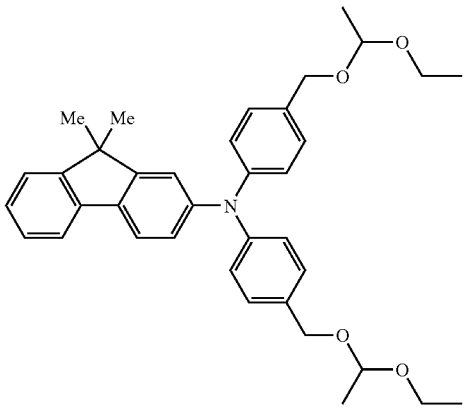

TABLE 11

III-13

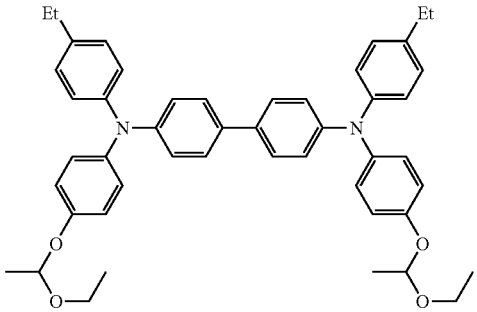

III-14

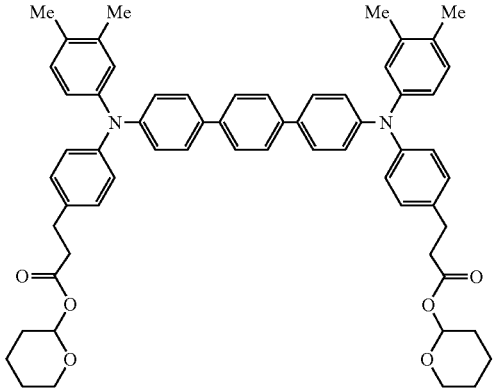

III-15

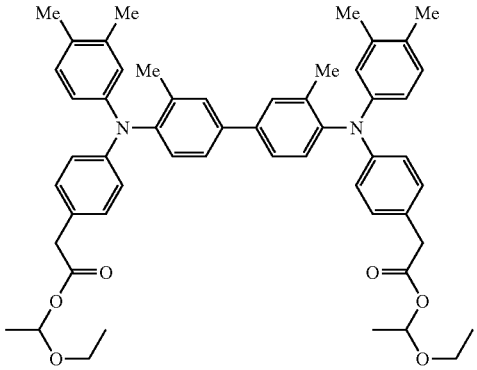

TABLE 11-continued

III-16

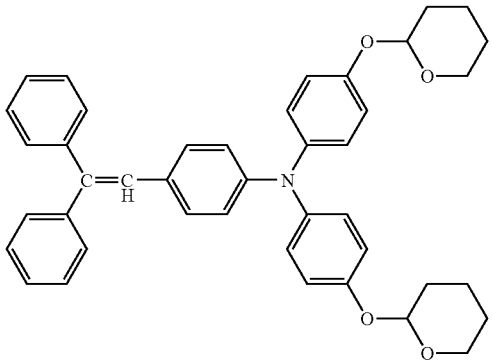

III-17

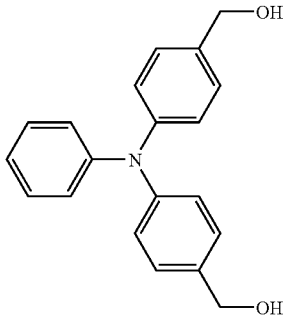

III-18

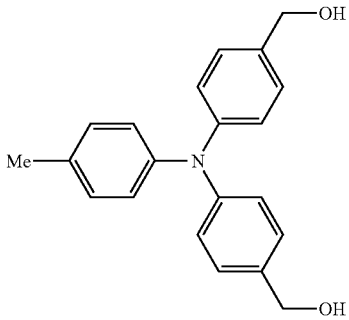

As the specific examples of the compounds represented by formula (IV), the following shown compounds (IV-1) to (IV-13) are exemplified. The compounds represented by formula (IV) are by no means restricted to these compounds. Further, in the following table, those in which Me or bonding hands are described but substitutents are not shown are methyl groups.

TABLE 12

IV-1

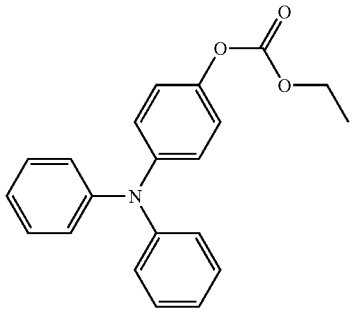

TABLE 12-continued
IV-2
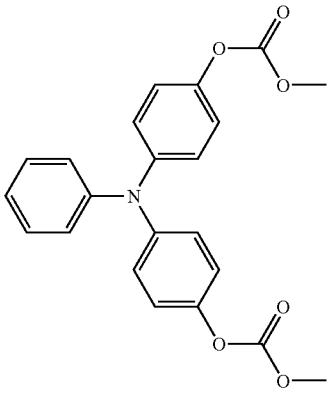
IV-3
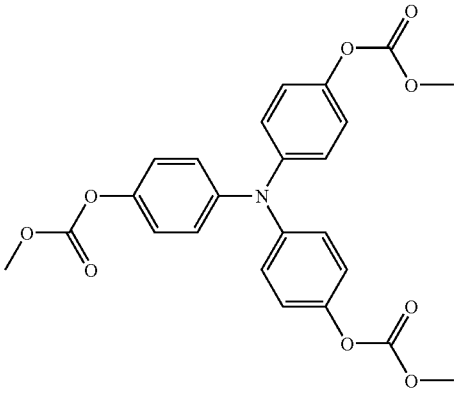
IV-4
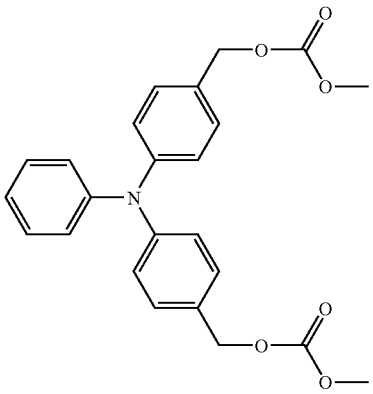
IV-5
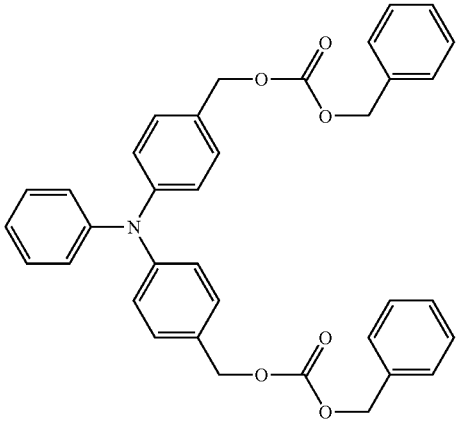
TABLE 12-continued
IV-6
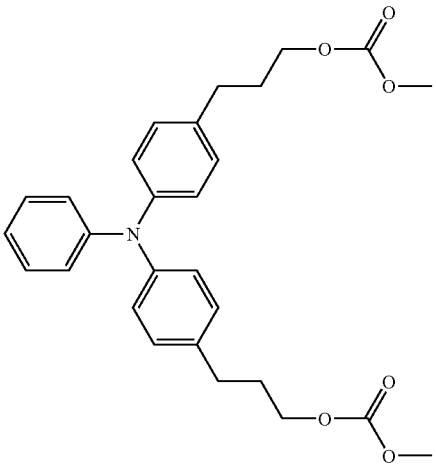
IV-7
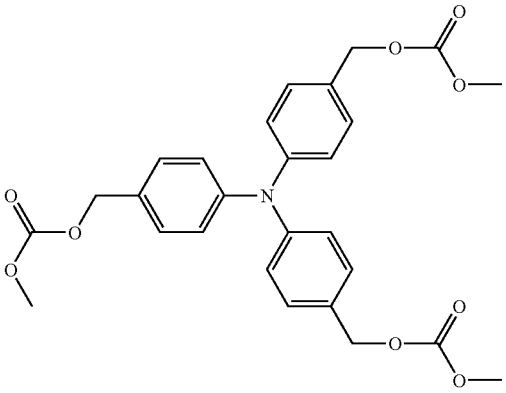
IV-8
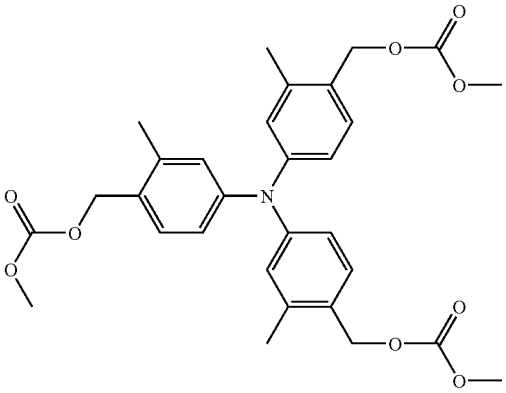

TABLE 13

IV-9

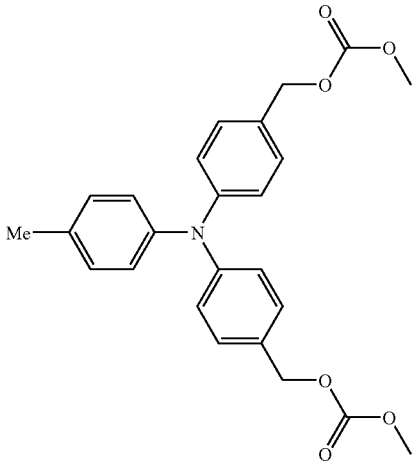

IV-10

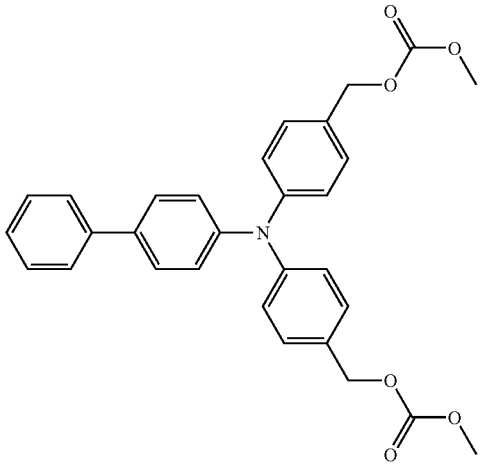

IV-11

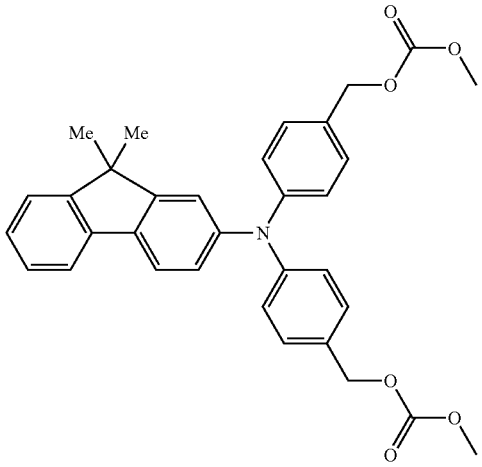

TABLE 13-continued

IV-12

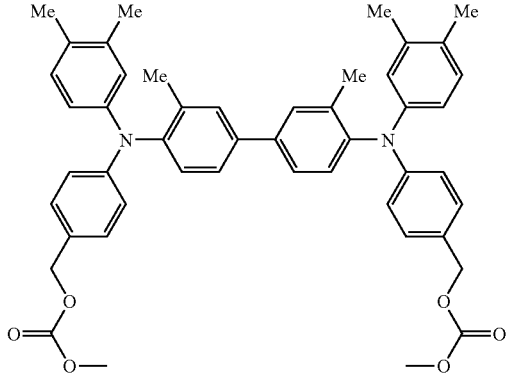

IV-13

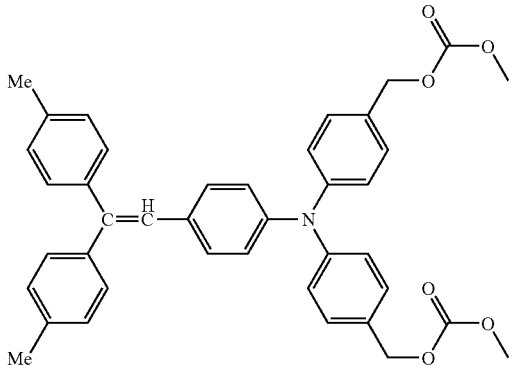

As the specific examples of the compounds represented by formula (V), the following shown compounds (V-1) to (V-17) are exemplified. The compounds represented by formula (V) are by no means restricted to these compounds. Further, in the following table, those in which Me or bonding hands are described but substitutents are not shown are methyl groups, and Et represents an ethyl group.

TABLE 14

V-1

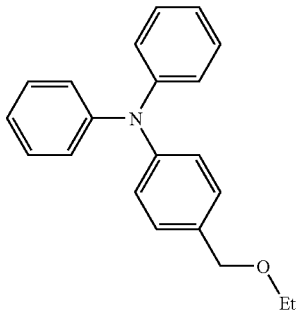

V-2

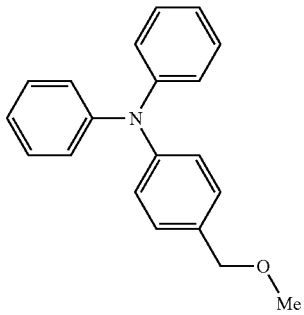

TABLE 14-continued
V-3
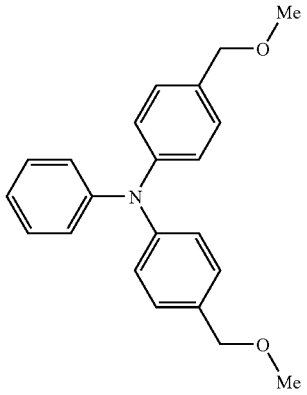
V-4
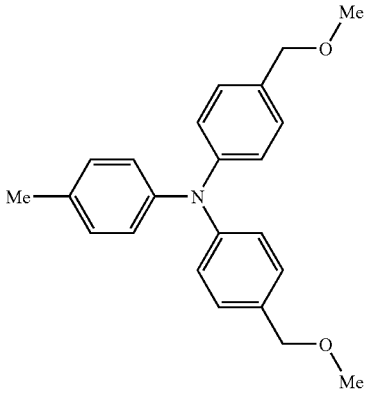
V-5
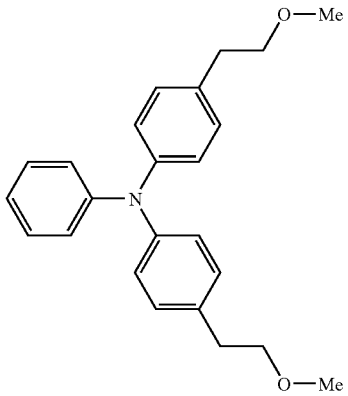
V-6
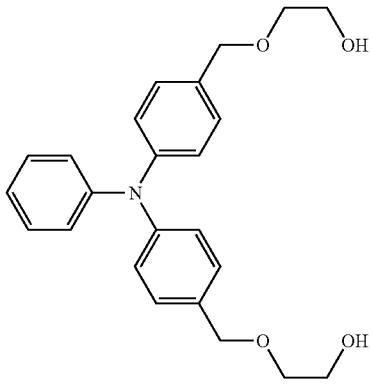
TABLE 15
V-7
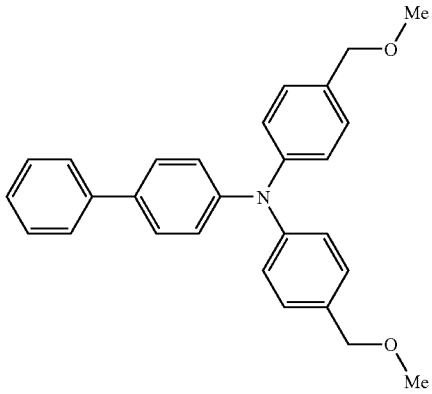
V-8
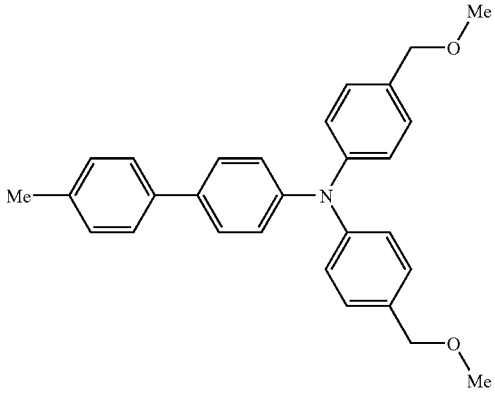
V-9
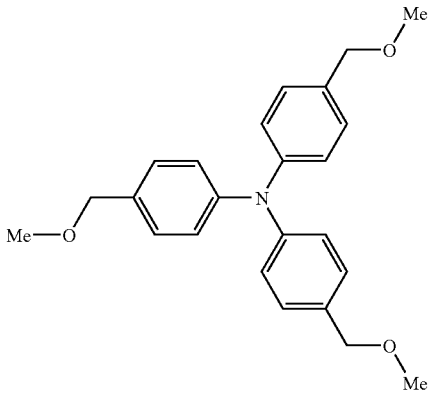
V-10
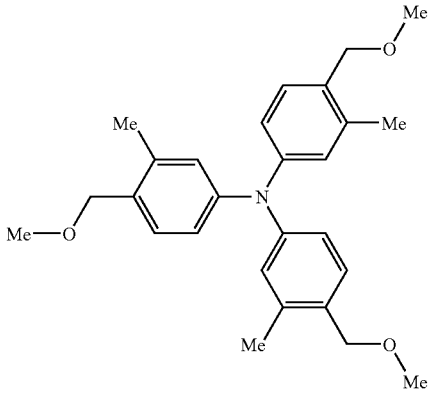

TABLE 15-continued

V-11

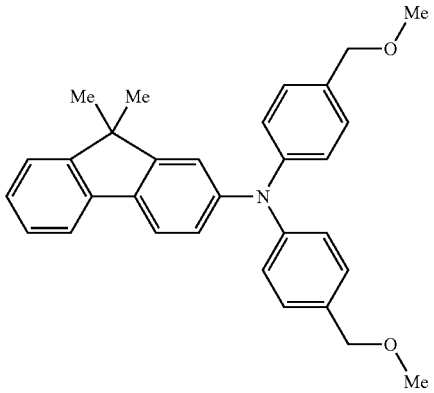

V-12

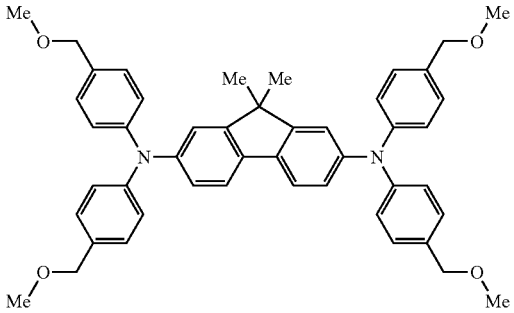

TABLE 16

V-13

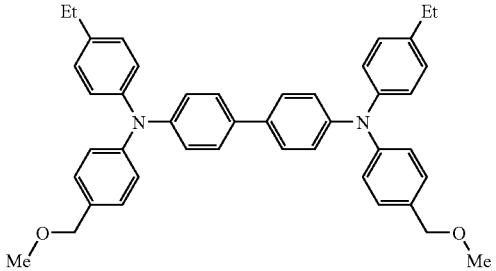

V-14

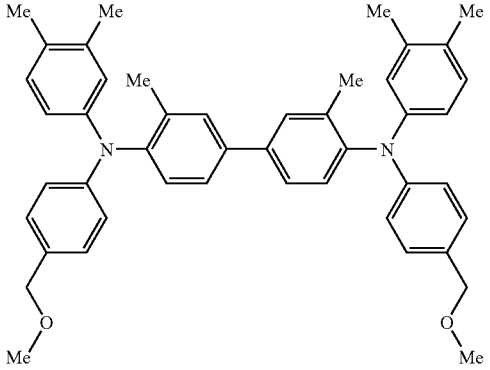

TABLE 16-continued

V-15

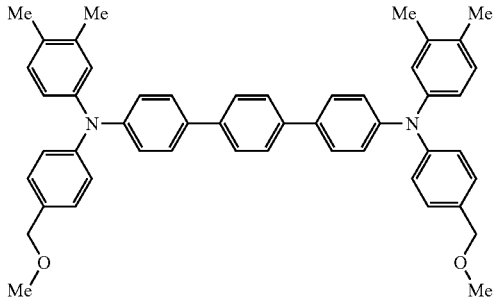

V-16

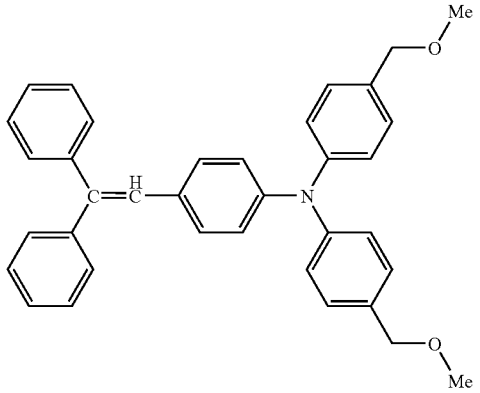

V-17

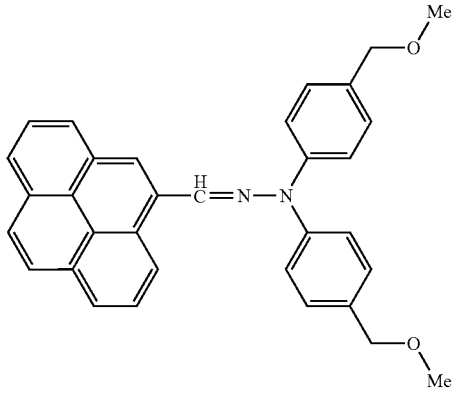

The protective layer 7 may comprise at least one resin selected from the group consisting of silicone resin, epoxy resin, acrylic resin, phenolic resin and melamine resin, preferably comprise at least one resin selected from the group consisting of epoxy resin, acrylic resin and phenolic resin, and especially preferably a layer comprising phenolic resin.

When the protective layer 7 is formed of a crosslinked film having a phenol structure, a phenol derivative having a methylol group can be used.

As the phenol derivatives having a methylol group, monomethylolphenols, dimethylolphenols, trimethylolphenols, mixtures thereof, oligomerized products thereof, and mixtures of monomers and oligomers thereof are exemplified. Such phenol derivatives having a methylol group are obtained by the reaction of compounds having a phenol structure, such as resorcin, bisphenol, etc., substituted phenols having one hydroxyl group, e.g., phenol, cresol, xylenol, paraalkylphenol, paraphenylphenol, etc., substituted phenols having two hydroxyl groups, e.g., catechol, resorcinol, hydroquinone, etc., bisphenols, e.g., bisphenol A, bisphenol Z, etc., or biphenols, with formaldehyde, paraformaldehyde, etc., in the presence of an acid catalyst or alkali catalyst, and those on the market as phenolic resins can also be used. Incidentally, in the specification, a relatively large molecule comprising repeating units of from about 2 to 20 or so is called an oligomer and smaller than that is called a monomer.

As the acid catalysts, sulfuric acid, paratoluenesulfonic acid, phosphoric acid, etc., are used. As the alkali catalysts, hydroxides of alkaline metals, such as NaOH, KOH, $Ca(OH)_2$, $Ba(OH)_2$, etc., and alkaline earth metals, and amine catalysts are used. As the amine catalysts, ammonia, hexamethylenetetramine, trimethylamine, triethylamine, triethanolamine, etc., are exemplified, but not restricted thereto.

Of the above resins, resins synthesized with acid catalysts are generally called novolak resins, and those synthesized with basic catalysts are generally called resol resins, but since novolak resins are low in a thermosetting property and difficult to obtain the protective layer 7 having high strength, resol resins can be preferably used.

The protective layer 7 may be a layer cured with an acidic catalyst (acid catalyst). Further, the acid catalyst may be a sulfur-containing catalyst.

When basic catalysts are used, since crosslinking reaction progresses rapidly, an adhesive property to the lower layer, ghost and electric characteristics are liable to deteriorate. Accordingly, it is preferred to neutralize or wash the resin with an acid material, or bring into contact with adsorbents such as silica gel and the like, or ion exchange resin, to thereby inactivate, or eliminate the acid material. As the acid materials, hydrochloric acid, sulfuric acid, acetic acid, trifluoroacetic acid, nitric acid, phosphoric acid, etc., are exemplified, and these acids can be used by dissolving in water, or an appropriate solvent such as alcohol, e.g., methanol, ethanol, etc. Further, solid state acid materials can also be used, and by using solid state acid materials, remaining of bases can be controlled and, further, the solid state acid materials can be easily removed by filtration after performing stirring and contact treatment in the state of solution, so that high productivity can be ensured and most preferred. As the solid state acid materials, ion exchange resins, inorganic solids to the surface of which is bonded a group containing a protonic acid group, polyorganosiloxanes containing a protonic acid group, heteropoly acids, isopoly acids, mono-elemental metallic oxides, composite metallic oxides, clay minerals, metallic sulfates, metallic phosphates, and metallic nitrates are exemplified. The specific examples of these solid state acid materials are shown below.

As the ion exchange resins, Amberlite 15, Amberlite 200C, and Amberlist 15 (manufactured by Rohm & Haas Co.), Dowex MWC-1-H, Dowex 88, and Dowex HCR-W2 (manufactured by Dow Chemical Company), Lewatit SPC-100 and Lewatit SPC-118 (manufactured by Bayer), Diaion RCP-150H (manufactured by Mitsubishi Kasei Corp.), Sumikaion KC-470, Duolite C26-C, Duolite C-433, and Duolite 464 (manufactured by Sumitomo Chemical Co. Ltd.), Nafion-H (manufactured by Du Pont Kabushiki Kaisha), Purolite (manufactured by Ionex) are exemplified.

As the inorganic solids to the surface of which is bonded a group containing a protonic acid group, $Zr(O_3PCH_2CH_2SO_3H)_2$, and $Th(O_3PCH_2CH_2COOH)_2$ are exemplified. As the polyorganosiloxanes containing a protonic acid group, polyorganosiloxanes having a sulfonic acid group are exemplified.

As the heteropoly acids, cobalttungstic acid and phosphomolybdic acid are exemplified. As the isopoly acids, niobic acid, tantalic acid and molybdic acid are exemplified.

As the mono-elemental metallic oxides, silica gel, alumina, chromia, zirconia, CaO and MgO are exemplified. As the composite metallic oxides, silica-alumina, silica-magnesia, silica-zirconia and zeolite are exemplified. As the clay minerals, acid clay, activated clay, montmorillonite and kaolinite are exemplified.

As the metallic sulfates, $LiSO_4$ and $MgSO_4$ are exemplified. As the metallic phosphates, zirconia phosphate and lanthanum phosphate are exemplified. As the metallic nitrates, $LiNO_3$ and $Mn(NO_3)_2$ are exemplified.

As the conditions for treating phenolic resin with an acid material, 1 weight part of phenolic resin is dissolved with from about 1 to 100 weight parts of a solvent, preferably from about 1 to 10 weight parts, and the resulting solution is subjected to stirring treatment with an acid material of the amount that is sufficient to neutralize a residual basic material, specifically the amount capable of making pH of the solution after performing the desired treatment about 7 or less. For removing the acid material from the treated solution, the solution may further be washed with water, or the acid material may be removed by filtration alone. The treating time can be from about 1 to 300 minutes, and the temperature can be from a room temperature to about 50° C.

The protective layer 7 may contain conductive particles to lower residual potential. As the conductive particles, metals, metallic oxides and carbon blacks are exemplified, and metals and metallic oxides are more preferred. As the metals, aluminum, zinc, copper, chromium, nickel, silver, stainless steel and the like, and plastic particles deposited with these metals on the surfaces thereof are exemplified. As the metallic oxides, zinc oxide, titanium oxide, tin oxide, antimony oxide, indium oxide, bismuth oxide, indium oxide doped with tin, tin oxide doped with antimony or tantalum, and zirconium oxide doped with antimony are exemplified. These particles can be used alone, or two or more kinds of particles can be used in combination. When two or more conductive particles are used in combination, they may be merely blended, or may take the form of solid solution or fusion. The average particle size of the conductive particles is preferably about 0.3 μm or less in the point of transparency of the protective layer 7, and especially preferably about 0.1 μm or less.

Further, in forming the protective layer 7, a catalyst can be used for accelerating the curing of phenolic resin. As the catalysts, those showing acidity at a room temperature or after heating may be used, and in view of an adhesive property, ghost restraint and electric characteristics, organic sulfonic acids and/or derivatives thereof are preferred. The presence of these catalysts in the protective layer 7 can be easily confirmed according to XPS and the like.

As the organic sulfonic acids and/or derivatives thereof, e.g., paratoluenesulfonic acid, dinonylnaphthalenesulfonic acid (DNNSA), dinonylnaphthalenedisulfonic acid (DNNDSA), dodecylbenzenesulfonic acid and phenolsulfonic acid are exemplified. Of these compounds, from the aspects of catalytic ability and a film forming property, paratoluenesulfonic acid and dodecylbenzenesulfonic acid are preferred. Further, in forming the protective layer 7, organic sulfonic acid salts can be used in a coating solution for forming a protective layer if they are dissociable in a certain degree.

By the use of what is called heat-latent catalyst that increases catalytic performance when a certain level or higher temperature is applied at the time of curing, catalytic performance is low at storage temperature of solution and catalytic performance rises at curing time, so that lowering of curing temperature and storage stability is compatible.

As the heat-latent catalysts, e.g., microcapsules obtained by enveloping an organic sulfonic acid compound and the like in polymer particles, those obtained by adsorbing acid and the like onto a porous compound such as zeolite, heat-latent protonic acid catalyst obtained by blocking protonic acid and/or protonic acid derivative with bases, those obtained by esterifying protonic acid and/or protonic acid derivative with primary or secondary alcohol, those obtained by blocking protonic acid and/or protonic acid derivative with vinyl ethers and/or vinyl thioether, monoethylamine complex of boron trifluoride, pyridine complex of boron trifluoride, etc., are exemplified. Of these heat-latent catalysts, those obtained by blocking protonic acid and/or protonic acid derivative with bases are preferred in the points of catalytic performance, storage stability, availability and costs.

As the examples of protonic acids of the heat-latent protonic acid catalyst, sulfuric acid, hydrochloric acid, acetic acid, formic acid, nitric acid, phosphoric acid, sulfonic acid, monocarboxylic acid, polycarboxylic acid, propionic acid, oxalic acid, benzoic acid, acrylic acid, methacrylic acid, itaconic acid, phthalic acid, maleic acid, benzenesulfonic acid, o,m,p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid are exemplified. As the examples of protonic acid derivatives, neutralized product of alkali metal salts or alkaline earth metal salts of protonic acid such as sulfonic acid or phosphoric acid, and high molecular compounds to the high molecular chain of which a protonic acid skeleton is introduced (polyvinyl sulfonic acid and the like) are exemplified. As the base that blocks protonic acid, amines are exemplified.

The amines are classified to primary, secondary and tertiary amines, but any of them can be used in the invention with no particular limitation.

As the primary amines, methylamine, ethylamine, propylamine, isopropylamine, n-butylamine, isobutylamine, t-butylamine, hexylamine, 2-ethylhexylamine, sec-butylamine, allylamine, and methylhexylamine are exemplified.

As the secondary amines, dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di-sec-butylamine, diallylamine, N-methylhexylamine, 3-pipecoline, 4-pipecoline, 2,4-lupetidine, 2,6-lupetidine, 3,5-lupetidine, morpholine, and N-methylbenzylamine are exemplified.

As the tertiary amines, trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)-pyridine, imidazole, and N-methylpiperazine are exemplified.

As commercially available products of the heat-latent acid catalysts, "NACURE 2501" (toluenesulfonic acid dissociation, methanol/isopropanol solvent, pH: from 6.0 to 7.2, dissociation temperature: 80° C.), "NACURE 2107" (p-toluenesulfonic acid dissociation, isopropanol solvent, pH: from 8.0 to 9.0, dissociation temperature: 90° C.), "NACURE 2500" (p-toluenesulfonic acid dissociation, isopropanol solvent, pH: from 6.0 to 7.0, dissociation temperature: 65° C.), "NACURE 2530" (p-toluenesulfonic acid dissociation, methanol/isopropanol solvent, pH: from 5.7 to 6.5, dissociation temperature: 65° C.), "NACURE 2547" (p-toluenesulfonic acid dissociation, aqueous solution, pH: from 8.0 to 9.0, dissociation temperature: 107° C.), "NACURE" 2558 (p-toluenesulfonic acid dissociation, ethylene glycol solvent, pH: from 3.5 to 4.5, dissociation temperature: 80° C.), "NACURE XP-357" (p-toluenesulfonic acid dissociation, methanol solvent, pH: from 2.0 to 4.0, dissociation temperature: 65° C.), "NACURE XP-386" (p-toluenesulfonic acid dissociation, aqueous solution, pH: from 6.1 to 6.4, dissociation temperature: 80° C.), "NACURE XC-2211" (p-toluenesulfonic acid dissociation, pH: from 7.2 to 8.5, dissociation temperature: 80° C.), "NACURE 5225" (dodecylbenzenesulfonic acid dissociation, isopropanol solvent, pH: from 6.0 to 7.0, dissociation temperature: 120° C.), "NACURE 5414" (dodecylbenzenesulfonic acid dissociation, xylene solvent, dissociation temperature: 120° C.), "NACURE 5528" (dodecylbenzenesulfonic acid dissociation, isopropanol solvent, pH: from 7.0 to 8.0, dissociation temperature: 120° C.), "NACURE 5925" (dodecylbenzenesulfonic acid dissociation, pH: from 7.0 to 7.5, dissociation temperature: 130° C.), "NACURE 1323" (dinonylnaphthalenesulfonic acid dissociation, xylene solvent, pH: from 6.8 to 7.5, dissociation temperature: 150° C.), "NACURE 1419" (dinonylnaphthalenesulfonic acid dissociation, xylene/methyl isobutyl ketone solvent, dissociation temperature: 150° C.), "NACURE 1557" (dinonylnaphthalenesulfonic acid dissociation, butanol/2-butoxyethanol solvent, pH: from 6.5 to 7.5, dissociation temperature: 150° C.), "NACURE X49-110" (dinonylnaphthalenedisulfonic acid dissociation, isobutanol/isopropanol solvent, pH: from 6.5 to 7.5, dissociation temperature: 90° C.), "NACURE 3525" (dinonylnaphthalenedisulfonic acid dissociation, isobutanol/isopropanol solvent, pH: from 7.0 to 8.5, dissociation temperature: 120° C.), "NACURE 383" (dinonylnaphthalenedisulfonic acid dissociation, xylene solvent, dissociation temperature: 120° C.), "NACURE 3327" (dinonylnaphthalenedisulfonic acid dissociation, isobutanol/isopropanol solvent, pH: from 6.5 to 7.5, dissociation temperature: 150° C.), "NACURE 4167" (phosphoric acid dissociation, isopropanol/isobutanol solvent, pH: from 6.8 to 7.3, dissociation temperature: 80° C.), "NACURE XP-297" (phosphoric acid dissociation, water/isopropanol solvent, pH: from 6.5 to 7.5, dissociation temperature: 90° C.), and "NACURE 4575" (phosphoric acid dissociation, pH: from 7.0 to 8.0, dissociation temperature: 110° C.) (manufactured by King Industries Inc.) are exemplified.

These heat-latent catalysts can be used alone, or two or more kinds in combination.

The blending amount of the heat-latent catalyst is preferably from about 0.01 to 20 weight parts per 100 weight parts of the solid content in the phenolic resin solution, and more preferably from about 0.1 to 10 weight parts. When the addition amount exceeds about 20 weight parts, the heat-latent catalyst shows a tendency to precipitate as a foreign matter after baking treatment, while when the amount is less than about 0.01 weight parts, the catalytic activity is liable to lower.

The protective layer 7 may further contain other coupling agents and fluorine compounds for the purpose of the adjustment of the forming property, flexibility, lubricating property and adhesive property of the film. As such compounds, various kinds of silane coupling agents and commercially available silicone hard coat agents can be used.

As the silane coupling agents, vinyl trichlorosilane, vinyl methoxysilane, vinyl ethoxysilane, γ-glycidoxypropylmethyldiethoxysilane, γ-glycidoxypropyltriethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane can be used.

As the commercially available silicone hard coat agents, KP-85, X-40-9740, X-8239 (manufactured by Shin-Etsu Chemical Co., Ltd, Silicone Division), AY42-440, AY42-441, AY49-208 (manufactured by Dow Corning) can be used.

For giving water repellency, fluorine-containing compounds, e.g., (tridecafluoro-1,1,2,2-tetrahydrooctyl)-triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be used.

Silane coupling agents can be used in an arbitrary amount. The amount of fluorine-containing compounds is preferably about 0.25 times or less the compounds not containing fluorine. When the amount exceeds this range, there are cases where a problem arises in a film forming property of a crosslinked film.

For the purposes of resistance to charging gas, mechanical strength, scratch resistance, particle dispersibility, control of viscosity, the reduction of torque, control of abrasion loss, and extension of pot life of the protective layer 7, resins soluble in alcohol solvents can be added.

As the resins soluble in alcohol solvents, polyvinyl butyral resins, polyvinyl formal resins, polyvinyl acetal resins such as partially acetalized polyvinyl acetal resins, e.g., a part of butyral is modified with formal and acetoacetal (e.g., Eslec B and K, manufactured by Sekisui Chemical Co., Ltd.), polyamide resins, cellulose resins, and polyvinyl phenol resins are exemplified. Polyvinyl acetal resins and polyvinyl phenol resins are especially preferred in the point of electric characteristics.

The average molecular weight of these resins is preferably from about 2,000 to 100,000, and more preferably from about 5,000 to 50,000. When the molecular weight of the resins is less than about 2,000, the effect by the addition of the resins is liable to be insufficient, while when it is higher than about 100,000, the solubility lowers, therefore, the addition amount is restricted and, further film failure is liable to occur in coating.

The addition amount of the resin is preferably from about 1 to 40 weight %, more preferably from about 1 to 30 weight %, and still more preferably from about 5 to 20 weight %. When the addition amount of the resin is less than about 1 weight %, the effect by the addition of the resin is liable to be insufficient, while when it is higher than about 40 weight %, image blurring is liable to occur under high temperature and high humidity conditions.

The protective layer 7 can be formed with a coating solution for forming a protective layer containing various kinds of materials and additives described above. The coating solution for forming a protective layer can be prepared with no solvent, or with a solvent such as alcohols, e.g., methanol, ethanol, propanol, butanol, etc.; ketones, e.g., acetone, methyl ethyl ketone, etc.; or ethers, e.g., tetrahydrofuran, diethyl ether, dioxane, etc., according to necessity. These solvents can be used alone, or two or more as blending, but it is preferred to use solvents having a boiling point of about 100° C. or lower.

The amount of the solvent can be set arbitrarily, but when the amount is too small, the compound represented by any of formulae (I) to (V) is liable to precipitate, so that the solvent is used in an amount of preferably from about 0.5 to 30 weight parts per 1 weight part of the compound (I), (II), (III), (IV) or (V), and more preferably from 1 to about 20 weight parts.

Further, the protective layer-forming coating solution containing the above components may be prepared by merely blending and dissolving, or may be prepared by heating at a room temperature to about 100° C., preferably from about 30 to 80° C., for about 10 minutes to 100 hours, preferably from 1 to 50 hours. At this time, it is also preferred to apply ultrasonic waves. By irradiation with ultrasonic waves, partial reaction probably progresses and the coating solution becomes homogeneous, so that a uniform film free from film defects can be easily obtained.

In coating the protective layer-forming coating solution on charge transporting layer 6, ordinary coating methods, e.g., a blade coating method, a wire bar coating method, a spray coating method, an dip coating method, a bead coating method, an air knife coating method, a curtain coating method and the like can be used. After coating, the coated layer is dried, thus the protective layer 7 is formed.

When a necessary film thickness is not obtained by one time of coating, a necessary film thickness can be obtained by recoating a plurality of times. When recoating is performed a plurality of times, heat treatment may be carried out every time of coating, or may be carried out after recoating of a plurality of times.

The reaction temperature and reaction time at the time of curing the curing components in the protective layer-forming coating solution are not especially restricted but from the points of mechanical strength and chemical stability of resin to be obtained, the reaction temperature is preferably about 60° C. or higher, more preferably from about 80 to 200° C., and the reaction time is preferably from about 10 minutes to 5 hours. It is also effective, in devising the stability of the characteristics of the organic layer, to maintain an organic layer obtained by curing the coating solution in a high humidity condition. Further, the protective layer 7 obtained can be hydrophobitized by performing surface treatment with hexamethyldisilazane or trimethylchlorosilane according to purpose.

The thickness of the protective layer 7 that is the outermost surface layer is preferably about 2 μm or more, more preferably from about 2.5 to 10 μm, and still more preferably from about 3 to 9 μm.

An antioxidant can be added to the protective layer 7 for the purpose of prevention of deterioration due to oxidizing gas such as ozone generated at the charging unit. When the mechanical strength of the surface of a photoreceptor is heightened and the duration of life of the photoreceptor is prolonged, the photoreceptor is to be brought into contact with oxidizing gas for hours, so that stronger resistance to oxidation is required. As the antioxidants, hindered phenols or hindered amines are exemplified, and known antioxidants such as organic sulfur antioxidants, phosphite antioxidants, dithiocarbamate antioxidants, thiourea antioxidants, and benzimidazole antioxidants may be used. The addition amount of the antioxidant is preferably about 20 weight % or less based on the total amount of the solids content in the protective layer 7, and more preferably about 10 weight % or less.

As the hindered phenol antioxidants, 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzylphosphonate-diethyl ester, 2,4-bis [(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, 4,4'-butylidenebis(3-methyl-6-t-butylphenol) are exemplified.

Further, for improving resistance to adhesion of contaminants and the lubricating property of the surface of an electrophotographic photoreceptor, various kinds of particles can be added to the protective layer 7. As one example of particles, silicon-containing particles can be exemplified. Silicon-containing particles are particles containing silicon in the constitutional elements, and specifically colloidal silica and silicone particles are exemplified. The colloidal silica used as the silicon-containing particles are selected from the particles comprising silica having an average particle size of from about 1 to 100 nm, preferably from about 10 to 30 nm, having been dispersed in an acid or alkali aqueous dispersion medium or in an organic solvent such as alcohol, ketone, or ester, and those generally on the market can also be used. The solid content of the colloidal silica in the protective layer 7 is not especially restricted, but from the aspects of film-forming property, electric characteristics and strength, the content is from about 0.1 to 50 weight % based on the total amount of the solids content in the protective layer 7, and preferably in the range of from about 0.1 to 30 weight %.

The silicone particles used as the silicon-containing particles are selected from silicone resin particles, silicone rubber particles, and silica particles surface treated with silicone, and silicone particles generally on the market can be used. These silicone particles are spherical, and the average particle size is from about 1 to 500 nm, and more preferably from about 10 to 100 nm. The silicone particles are chemically inert and micro size particles excellent in dispersibility in resin, and further the content necessary to obtain sufficient characteristics is low, so that the silicone particles can improve the surface properties of the electrophotographic photoreceptor without hindering the crosslinking reaction. That is, the silicone particles can improve the lubricating property and water repellency of the surface of the electrophotographic photoreceptor in the state of being taken in into the tenacious crosslinking structure, and can maintain good abrasion resistance and resistance to adhesion of contaminants over a long period of time. The content of the silicone particles in the protective layer 7 is preferably from about 0.1 to 30 weight % based on the total solids content in the protective layer 7, and more preferably from about 0.5 to 10 weight %.

Further, as other particles, fluorine particles, e.g., ethylene tetrafluoride, ethylene trichloride, propylene hexafluoride, vinyl fluoride, vinylidene fluoride, etc., particles comprising resins obtained by copolymerization of fluorine resins and monomers having a hydroxyl group shown in the draft of lecture in the $8^{th}$ Polymer Material Forum, p. 89, and semiconductive metallic oxides, e.g., $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, MgO, etc., are exemplified.

Further, oils such as silicone oil can be added for the same purpose. As the silicone oils, silicone oils, e.g., dimethylpolysiloxane, diphenylpolysiloxane, phenylmethylsiloxane, etc.; reactive silicone oils, e.g., amino-modified polysiloxane, epoxy-modified polysiloxane, carboxyl-modified polysiloxane, carbinol-modified polysiloxane, methacryl-modified polysiloxane, mercapto-modified polysiloxane, phenol-modified polysiloxane, etc.; cyclic dimethylcyclosiloxanes, e.g., hexamethylcyclotrisiloxane, octamethylcyclotetrasiloxane, decamethylcyclopentasiloxane, dodecamethylcyclohexasiloxane, etc.; methylphenylcyclosiloxanes, e.g., 1,3,5-trimethyl-1,3,5,-triphenylcyclotrisiloxane, 1,3,5,7-tetraphenylcyclotetrasiloxane, 1,3,5,7,9-pentamethyl-1,3,5,7,9-pentaphenylcyclopentasiloxane, etc.; cyclic phenylcyclosiloxanes, e.g., hexaphenylcyclotrisiloxane, etc.; fluorine-containing cyclosiloxane, e.g., (3,3,3-trifluoropropyl)methylcyclotrisiloxane, etc.; hydrosilyl group-containing cyclosiloxanes, e.g., methylhydrosiloxane admixture, pentamethylcyclopentasiloxane, phenylhydrocyclosiloxane, etc.; and vinyl group-containing cyclosiloxanes, e.g., pentavinylpentamethylcyclopentasiloxane are exemplified.

Further, as the electrophotographic photoreceptor shown in FIG. 3, when the photosensitive layer 3 has the monolayer type photosensitive layer 8, the monolayer type photosensitive layer 8 is formed of at least a charge generating material and binder resin. As the charge generating materials, the same materials as used in the charge generating layer 5 in the function-separating type photosensitive layer, and as the binder resins, the same binder resins used in the charge generating layer 5 and the charge transporting layer 6 in the function-separating type photosensitive layer can be used respectively. The content of the charge generating material in the monolayer type photosensitive layer 8 is preferably from about 10 to 85 weight % based on the total solids content in the monolayer type photosensitive layer 8, and more preferably from about 20 to 50 weight %. Charge transporting materials and high molecular charge transporting materials may be added to the monolayer type photosensitive layer 8 for the purpose of the improvement of photoconductive characteristics and the like. The same materials as used in the charge transporting layer 6 can be used. The addition amount of the charge transporting materials and high molecular charge transporting materials is preferably from about 5 to 50 weight % based on the total amount of the solids content in the monolayer type photosensitive layer 8. The solvents and coating methods used in coating can be the same as in the charge generating layer 5 and the charge transporting layer 6. The thickness of the monolayer type photosensitive layer 8 is preferably from about 5 to 50 μm, and more preferably from about 10 to 40 μm.

Figure 4:
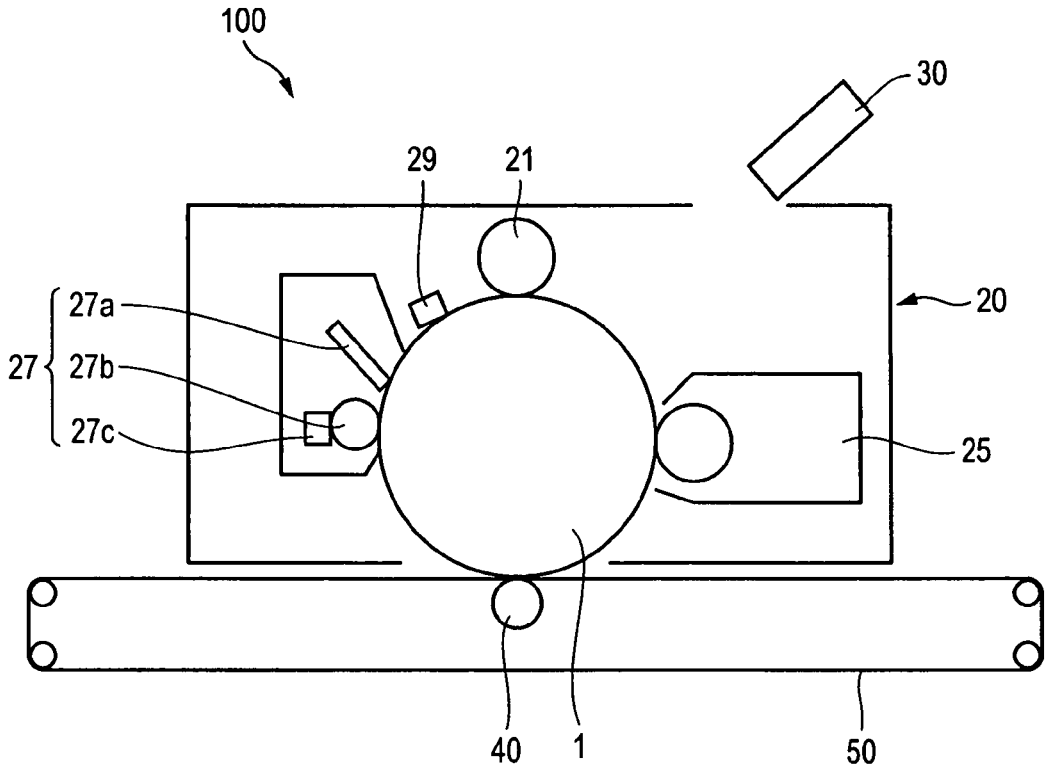
FIG. 4 is a view showing an exemplary embodiment of an image forming apparatus in the invention.

Image Forming Apparatus and Process Cartridge:

FIG. 4 is a drawing showing an exemplary embodiment of an image forming apparatus of the invention. An image forming apparatus 100 shown in FIG. 4 comprises a process cartridge 20 equipped with an electrophotographic photoreceptor 1, an exposure unit 30, a transfer unit 40, and an intermediate transfer medium 50 mounted on the main body of an image forming apparatus (not shown). In the image forming apparatus 100, the first exposure unit 30 is arranged at the position capable of exposure of the electrophotographic photoreceptor 1 from the opening of the process cartridge 20, transfer unit 40 is arranged at the position opposed to the electrophotographic photoreceptor 1 via the intermediate transfer medium 50, and the intermediate transfer medium 50 is arranged so as to be capable of partly contacting with the electrophotographic photoreceptor 1.

The process cartridge 20 comprises integration of the charging unit 21, the developing unit 25, the cleaning unit 27, and the second exposure unit 29 together with the electrophotographic photoreceptor 1, combined by a fixing rail and accommodated in a case. The case is equipped with an opening for exposure.

The cleaning unit 27 has a cleaning blade 27*a* (a cleaning member), and the cleaning blade 27*a* is arranged so as to be contact with the surface of the electrophotographic photoreceptor 1. Further, in the image forming apparatus 100, an example of arranging the second exposure unit 29 behind the cleaning blade 27*a* is shown, but the position of the second exposure unit 29 can be changed according to necessity. Further, as the cleaning unit 27, an example of using a fibrous member 27*b* for supplying a lubricant 27*c* to the surface of the photoreceptor 1 is shown, and which member can be used according to necessity. Incidentally, the form of the fibrous member 27*b* is not especially restricted and, for example, roll-like and tooth brush-like forms are exemplified.

As the charging unit 21, e.g., contact type chargers using a conductive or semiconductive charging roller, charging brush, charging film, charging rubber blade, and charging tube can be used. In addition, non-contact type roller chargers of using a charging roller in the vicinity of photoreceptor 1, and chargers well known of themselves such as a Scorotron charger and Corotron charger using corona discharge can also be used.

As the first exposure unit 30, e.g., optical apparatuses capable of desirably imagewise exposing the surface of the photoreceptor 1 with light, e.g., semiconductor laser beams, LED rays, liquid crystal shutter lights are exemplified. As the wavelengths of light sources, wavelengths in the spectral sensitivity region of the photoreceptor 1 are used. As the wavelengths of semiconductor laser beams, near infrared rays having oscillating wavelengths near to 780 nm are mainly used, but not restricted thereto, and lasers having oscillating wavelengths at the levels of 600 nm, and lasers having oscillating wavelengths at from about 400 to 450 nm as blue lasers can also be used. For color image formation, areal emission type laser light sources capable of multi-beam output are also effective.

As the second exposure unit 29, e.g., exposure units adjusted to desired wavelength through an optical filter using a tungsten lamp, a halogen lamp, or a cold cathode tube, and solid state component such as semiconductor laser, LED and organic EL can be used as the light sources. Of these units, those using semiconductor device may be used as light sources, and in view of on-off responsibility, wavelength selectivity, controllability of emission intensity, miniaturization and the like, LED may be especially used. As LED, for example, E1L49-3B1A*-02 having emission wavelength region of from 410 to 530 nm, E1L53-SC1A*-03 having emission wavelength region of from 430 to 560 nm, E1L49-3G1A*-02 having emission wavelength region of from 450 to 600 nm, and E1L49-4ROA*-00 having emission wavelength region of from 590 to 700 nm (the products manufactured by Toyoda Gosei Co., Ltd.) can be exemplified.

In the image forming apparatus 100, it is necessary that the outermost surface layer of the photoreceptor 1 (e.g., the protective layer 7, etc.) should have absorption to the exposure light of the second exposure unit 29. Further, in the image forming apparatus 100, it is necessary that the maximum absorbance of the outermost surface layer of the electrophotographic photoreceptor 1 in the entire wavelength range of the exposure light of the second exposure unit 29 is about 0.05 or less. Accordingly, the kind of light source of the second exposure unit 29 and the composition of the outermost surface layer of the electrophotographic photoreceptor 1 to be used should be determined for satisfying these conditions. For example, to the electrophotographic photoreceptor 1 having the protective layer 7 comprising the above composition as the outermost surface layer, the light source of second exposure unit 29 may be a light source capable of irradiating exposure light in the wavelength region of from about 400 to 900 nm, and more preferably capable of irradiating exposure light in the wavelength region of from about 400 to 800 nm.

Figure 6:
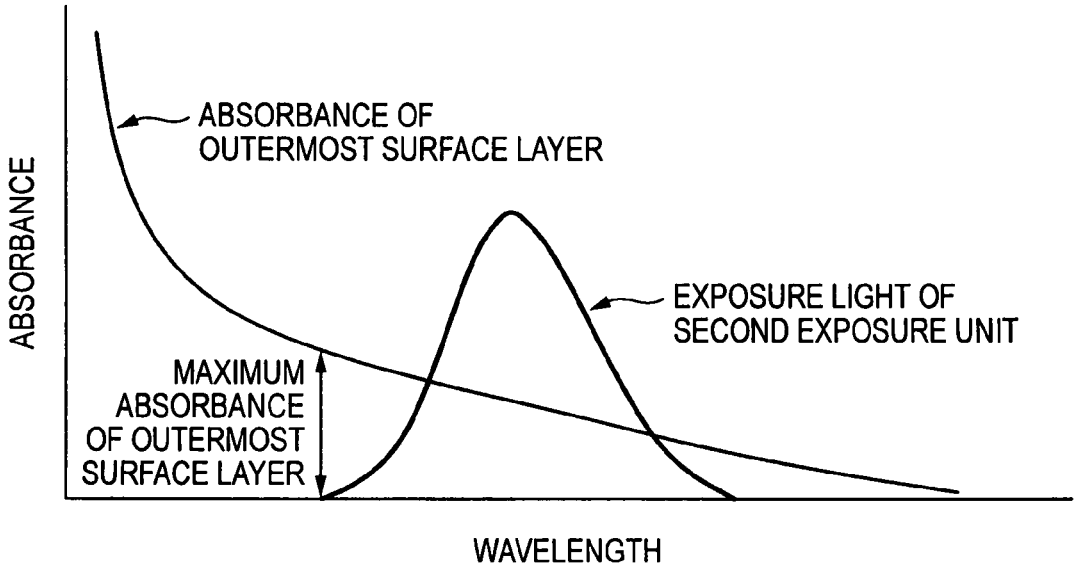
FIG. 6 is a view showing the definition of the maximum absorbance of the outermost surface layer of an electrophotographic photoreceptor in the entire wavelength range of the exposure light of the second exposure unit.

Here, "the maximum absorbance of the outermost surface layer of the electrophotographic photoreceptor in the entire wavelength range of the exposure light of the second exposure unit" is defined as shown in FIG. 6. That is, the maximum absorbance means, as shown in FIG. 6, when an absorption curve showing the relationship between the wavelength of the exposure light and the absorbance of the outermost surface layer is drawn, the maximum value of the absorbance on the curve in the wave region of the exposure light of the second exposure unit. Further, the outermost surface layer does not necessarily have absorption in the entire wavelength range of the exposure light of the second exposure unit, and it is sufficient to have absorption in at least a part of the wavelength region of the exposure light.

The mechanism of generation of ghost being inhibited by the exposure light of the second exposure unit 29 is not completely clear, but it is presumed that the exposure light of second exposure unit 29 is absorbed by the outermost surface layer of the electrophotographic photoreceptor 1, as a result charge carriers are generated in the outermost surface layer, and film resistance lowers to thereby easily release residual charge. Therefore, the maximum absorbance of the outermost surface layer of the electrophotographic photoreceptor 1 in the entire wavelength range of the exposure light of the second exposure unit 29 is necessary to be from more than 0 and about 0.05 or less, but the effect is difficult to obtain when the maximum absorbance is too small, and the film resistance excessively lowers when the maximum absorbance is too great, so that it is preferably from 0.001 to 0.047, and more preferably from 0.002 to 0.045. Further, the effect is difficult to obtain when the quantity of light of the second exposure unit 29 is too weak, and the film resistance excessively lowers when too strong, so that it is preferably from about 20 μW to 5 mW, and more preferably from about 30 μW to 3 mW.

The exposure by the second exposure unit 29 may be performed on a constant condition in each cycle of forming an image on photoreceptor 1 (erase exposure), or may be performed as pre-exposure prior to image forming cycle. Further, the exposure may be carried out during print job and can be set arbitrarily, but the exposure by combination of pre-exposure and erase exposure is especially effective.

In performing erase exposure, it is necessary to perform the exposure of the photoreceptor 1 by the second exposure unit 29 after performing electrostatic charge, exposure by the first exposure unit 30, development and transfer, and before performing electrostatic charge of the next image forming cycle, and it is more effective to perform erase exposure after elimination of the residual toner by the cleaning unit 27.

The second exposure unit 29 may also have a controller for control the quantity of light of exposure light (the first controller). As such a controller, e.g., a controller for controlling applied voltage and electric current on the basis of a condition, or by the detection of the surface potential and number of cycle of the photoreceptor is exemplified. By the provision of such a first controller, it becomes possible to easily adjust the quantity of light of exposure light to the above-described range.

Further, the second exposure unit 29 may have a controller for controlling irregularly irradiating the electrophotographic photoreceptor 1 with the exposure light (the second controller). As such a controller, e.g., a controller for controlling exposure timing on the basis of a condition, or by the detection of the surface potential and number of cycle of the photoreceptor is exemplified. By the provision of such a second controller, it becomes possible to optimally control generation of ghost.

As the developing unit 25, development can be carried out, e.g., with a generally used developing apparatus of performing development by contacting or not contacting a magnetic or nonmagnetic one-component system developer or two-component system developer with the photoreceptor 1. There is no limit on such a developing unit 25 so long as the unit has the above function, and the unit can be arbitrarily selected according to purpose. As such a developing unit 25, e.g., known developing apparatus having function of adhering the one-component system developer or two-component system developer to photoreceptor 1 with a brush or roller is exemplified.

The toners for use in developing unit 25 are described below.

From the viewpoint of obtaining a high developing ability, transfer ability, and a high image quality, the toners for use in the image forming apparatus 100 preferably have an average shape factor ($ML^2/A$) of from about 100 to 150, more preferably from about 105 to 145, and still more preferably from about 110 to 140. The toners also preferably have a volume average particle size of from about 3 to 12 μm, more preferably from about 3.5 to 10 μm, and still more preferably from about 4 to 9 μm. By using these toners satisfying the average shape factor and the volume average particle size, the developing ability and transfer ability are heightened, so that a high quality image of what is called a picture image can be obtained.

The toners are not especially restricted by the manufacturing methods so long as they satisfy the average shape factor and the volume average particle size, and toners manufactured by the following methods are used, for example, a kneading crushing method of kneading binder resin, a colorant, and a mold releaser and, if necessary, a charge controller, crushing and classifying; a method of changing the shape of the particles obtained by the kneading crushing method by mechanical impact force or heat energy; an emulsion polymerization agglomeration method of emulsion polymerizing the polymerizable monomers of binder resin, blending the above-obtained dispersion, a colorant, and a mold releaser and, if necessary, dispersion of a charge controller, agglomerating, and fusing by heating to obtain toner particles; a suspension polymerization method of performing polymerization by suspending the polymerizable monomers for obtaining binder resin, a colorant, and a mold releaser and, if necessary, a solution of a charge controller in an aqueous solvent; and a dissolution suspension method of granulation by suspending binder resin, a colorant, and a mold releaser and, if necessary, a solution of a charge controller in an aqueous solvent.

Further, known methods, such as a manufacturing method of further adhering agglomerated particles with the toners obtained by the above method as cores, and fusing the particles by heating to give core/shell structure to the particles can be used. Incidentally, as the manufacturing methods of toners, from the viewpoint of the control of particle shape and particle size distribution, the suspension polymerization method, emulsion polymerization agglomeration method, and dissolution suspension method of using aqueous solvents are preferred, and the emulsion polymerization agglomeration method is especially preferred.

Toner mother particles comprise binder resin, a colorant, and a mold releaser and, if necessary, silica and a charge controller.

The examples of the binder resins used in the toner mother particles include homopolymers and copolymers such as styrenes, e.g., styrene, chlorostyrene, etc., monoolefins, e.g., ethylene, propylene, butylene, isoprene, etc., vinyl esters, e.g., vinyl acetate, vinyl propionate, vinyl benzoate, vinyl butyrate, etc., α-methylene aliphatic monocarboxylic esters, e.g., methyl acrylate, ethyl acrylate, butylacrylate, dodecyl acrylate, octyl acrylate, phenyl acrylate, methyl methacrylate, ethyl methacrylate, butyl methacrylate, dodecyl methacrylate, etc., vinyl ethers, e.g., methyl vinyl ether, ethyl vinyl ether, butyl vinyl ether, etc., vinyl ketones, e.g., methyl vinyl ketone, hexyl vinyl ketone, isopropenyl vinyl ketone, etc., and polyester resins obtained by copolymerization of dicarboxylic acids and diols.

As especially representative resins, polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, polyester resins can also be exemplified. Further, polyurethane, epoxy resins, silicone resins, polyamide, modified rosins, paraffin waxes, etc., can be exemplified.

As the colorants, magnetic powders, e.g., magnetite, ferrite, etc., carbon black, Aniline Blue, Calucoyl Blue, Chromium Yellow, Ultramarine Blue, Du Pont Oil Red, Quinoline Yellow, Methylene Blue Chloride, Phthalocyanine Blue, Malachite Green Oxalate, lamp black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. Pigment Blue 15:3, etc., can be exemplified as representatives.

As the mold releasers, low molecular weight polyethylene, low molecular weight polypropylene, Fischer-Tropsch wax, montan wax, carnauba wax, rice wax, candelilla wax, etc., can be exemplified as representatives.

As the charge controllers, known ones can be used, and azo series metal complex compounds, metal complex compounds of salicylic acid, and resin type charge controllers having a polar group can be used. When a toner is manufactured by a wet method, it is preferred to use hardly water-soluble materials in the points of control of ionic strength and reduction of contamination by wastewater. The toners may be either magnetic toners containing magnetic materials or nonmagnetic toners not containing magnetic materials.

The toners for use in the developing unit 25 can be manufactured by blending the toner mother particles and external additives with a Henschel mixer or V blender. When toner mother particles are manufactured by a wet method, wet external addition is also possible.

Lubricating particles may be added to the toners used in the developing unit 25. As the lubricating particles, solid lubricants, e.g., graphite, molybdenumdisulfide, talc, fatty acid, fatty acid metal salt, etc., low molecular weight polyolefins, e.g., polypropylene, polyethylene, polybutene, etc., silicones having a softening point by heating, aliphatic amides, e.g., oleic acid amide, erucic acid amide, ricinoleic acid amide, stearic acid amide, etc., vegetable waxes, e.g., carnauba wax, rice wax, candelilla wax, Japan wax, jojoba oil, etc., animal waxes, e.g., bees wax, mineral and petroleum waxes, e.g., montan wax, ozokerite, ceresin, paraffin wax, microcrystalline wax, Fischer-Tropsch wax, etc., and modified products thereof can be used. These lubricating particles can be used one kind alone, or two or more kinds in combination. However, those having a volume average particle size of from about 0.1 to 10 μm are preferably used, and particles having these chemical structures may be crushed to make particle sizes uniform. The addition amount to the toners is preferably from about 0.05 to 2.0 weight %, and more preferably from about 0.1 to 1.5 weight %.

For the purpose of elimination of adhered substances and deteriorating substances on the surface of an electrophotographic photoreceptor, inorganic fine particles, organic fine particles, and composite fine particles obtained by adhering inorganic fine particles to the organic fine particles can be added to the toners used in the developing unit 25.

As the inorganic fine particles, various kinds of inorganic oxides, nitrides and borides, e.g., silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, boron nitride, etc., can be used.

Further, these inorganic fine particles may be treated with titanium coupling agents, e.g., tetrabutyl titanate, tetraoctyl titanate, isopropyltriisostearoyl titanate, isopropyltridecylbenzenesulfonyl titanate, bis(dioctylpyrophosphate)oxyacetate titanate, etc., and silane coupling agents, e.g., γ-(2-aminoethyl)aminopropyltrimethoxysilane, γ-(2-aminoethyl) aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, p-methylphenyltrimethoxysilane, etc. Further, inorganic fine particles subjected to hydrophobitizing treatment with higher fatty acid metal salts, e.g., silicone oil, aluminum stearate, zinc stearate, calcium stearate, etc., can be also used.

As the organic fine particles, styrene resin particles, styrene-acrylic resin particles, polyester resin particles, urethane resin particles, etc., can be exemplified.

The particle size of these fine particles is preferably from about 5 to 1,000 nm as a volume average particle size, more preferably from about 5 to 800 nm, and still more preferably from about 5 to 700 nm. When the volume average particle size is less than the value of the greatest lower bound of the above range, polishing ability is liable to be lost, while when it is higher than the value of the least upper bound of the above range, scratches are liable to be generated on the surface of the electrophotographic photoreceptor. It is also preferred that the sum total of the addition amount of the particles and lubricating particles is about 0.6 weight % or more.

As other inorganic oxides added to the toners, used may be small size inorganic oxides having a primary particle size of about 40 nm or less for the purpose of powder fluidity, charge control, etc., and to add thereto inorganic oxides having a greater particle size than that of the small size inorganic oxides for the purpose of the reduction of adhesion force and charge control. Known fine particles of inorganic oxides can be used, but silica and titanium oxide in combination can be used for performing precise charge control. Dispersibility increases by the surface treatment of the small size inorganic particles and the effect of improving powder fluidity becomes great. Used may be carbonates, e.g., calcium carbonate, magnesium carbonate, etc., and inorganic minerals, e.g., hydrotalcite, etc., for the purpose of removing refined discharging products.

Color toners for electrophotography are used as admixtures with a carrier, and as the carriers, iron powders, glass beads, ferrite powders, nickel powders, and these powders coated with resins on the surfaces are used. The blending proportion with the carrier can be arbitrarily set.

As the transfer unit 40, contact type transfer chargers using, e.g., a belt, a roller, a film, a rubber blade, etc., and transfer chargers well known of themselves such as a Scorotron charger and Corotron charger using corona discharge are exemplified.

As the intermediate transfer unit 50, belt-like articles (intermediate transfer belts) such as polyimide, polyamideimide, polycarbonate, polyallylate, polyester, rubber, etc., having semiconductivity are used. As the shape of intermediate transfer medium 50, drum-like articles can also be used besides the belt-like articles.

The image forming apparatus 100 may be equipped with, for example, a photo-destaticizing unit for performing photodestaticization of electrophotographic the photoreceptor 1, besides the above various units.

Figure 5:
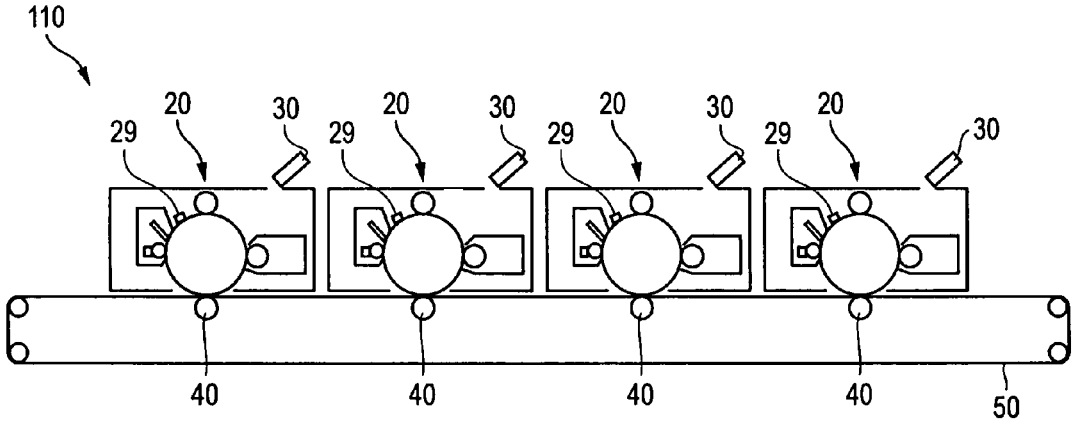
FIG. 5 is a view showing another exemplary embodiment of an image forming apparatus in the invention.

FIG. 5 is a view showing another exemplary embodiment of an image forming apparatus in the invention. An image forming apparatus 110 is a tandem system full color image forming apparatus mounting four process cartridges 20. In the image forming apparatus 110, four process cartridges 20 are arranged in a row on an intermediate transfer medium 50, and the image forming apparatus 110 has the constitution capable of using one electrophotographic photoreceptor per every one color. Except for being a tandem system, the image forming apparatus 110 has the same constitution as the image forming apparatus 100.

In the tandem system image forming apparatus 110, since electric characteristics of four the electrophotographic photoreceptors 1 are stabilized, image qualities excellent in color balance can be obtained over a longer period of time.

EXAMPLE

The invention will be described more specifically with reference to examples and comparative examples, but the invention is not limited thereto.

Base Resin 1 for Protective Layer:

Phenolic resin (PL-4852, manufactured by Gun Ei Chemical Industry Co., Ltd.) is prepared as base resin 1 for a protective layer.

Base Resin 2 for Protective Layer:

Alkylated melamine resin (MW-30HM, manufactured by Sanwa Chemical Co., Ltd.) is prepared as base resin 2 for a protective layer.

Base Resin 3 for Protective Layer:

Into a 2-liter flask are added 500 g of phenol, 862 g of a 35 weight % formaldehyde aqueous solution, and 5 g of triethylamine, after stirring the contents at 80° C. for 6 hours under nitrogen current, water is distilled under reduced pressure. Subsequently, the obtained product is dissolved in 2,500 g of ethyl acetate, and the resulted solution is neutralized with 10 ml of 1N hydrochloric acid, and then thoroughly washed with water. After separating the water layer, the solvent is distilled under reduced pressure, and 775 g of phenolic resin is obtained. To 300 g of the phenolic resin, 200 g of silicone resin (KP-854, manufactured by Shin-Etsu Chemical Co., Ltd) is added to thereby obtain mixed resin as base resin 3 for a protective layer.

Base Resin 4 for Protective Layer:

To 100 g of phenolic resin (PL-4852, manufactured by Gun Ei Chemical Industry Co., Ltd.) is added 50 g of bisphenol A epoxy resin (Epicote 828, manufactured by Japan Epoxy Resin Co., Ltd.) to obtain mixed resin as base resin 4 for a protective layer.

Base Resin 5 for Protective Layer:

Acrylic resin (KAYARAD TMPTA, manufactured by Nippon Co., Ltd.) is prepared as base resin 5 for a protective layer.

Photoreceptor 1:

Manufacture of Under Layer:

100 weight parts of zinc oxide (average particle size: 70 nm, specific surface area value: 15 $m^2/g$, manufactured by TAYCA CORPORATION) is blended by stirring with 500 weight parts of tetrahydrofuran, 1.3 weight parts of a silane coupling agent (KBM503, manufactured by Shin-Etsu Chemical Co., Ltd) is added thereto, and the reaction mixture is stirred for 2 hours. After that, toluene is distilled under reduced pressure, the reaction product is baked at 120° C. for 3 hours, and zinc oxide surface-treated with silane coupling agent is obtained.

110 weight parts of the obtained surface-treated zinc oxide is blended by stirring with 500 weight parts of tetrahydrofuran, and a solution obtained by dissolving 0.6 weight parts of alizarin in 50 weight parts of tetrahydrofuran is added thereto, and the reaction mixture is stirred at 50° C. for 5 hours. After that, zinc oxide adhered with alizarin is filtered under reduced pressure, dried at 60° C. under reduced pressure, thus zinc oxide adhered with alizarin is obtained.

38 weight parts of a solution obtained by dissolving 60 weight parts of the zinc oxide adhered with alizarin, 13.5 weight parts of blocked isocyanate (Sumidule 3175, manufactured by Sumitomo Bayer Urethane Co., Ltd.) as the curing agent, and 15 weight parts of butyral resin (S-Lec BM-1, manufactured by Sekisui Chemical Co., Ltd.) in 85 weight parts of methyl ethyl ketone, and 25 weight parts of methyl ethyl ketone are blended, and dispersed in a sand mill with glass beads of 1 mmϕ for 2 hours, thus dispersion is obtained.

To the obtained dispersion are added 0.005 weight parts of dioctyltin dilaurate as the catalyst, and 40 weight parts silicone resin particles (Tospearl 145, manufactured by GE Toshiba Silicones) to obtain a coating solution for forming an under layer. The coating solution is coated on an aluminum substrate having a diameter of 30 mm, a length of 340 mm, and a thickness of 1 mm by an dipcoating method, dried at 170° C. for 40 minutes to form an under layer having a thickness of 18 μm.

Manufacture of Charge Generating Layer:

A mixture comprising 15 weight parts of hydroxygallium phthalocyanine as charge generating material in which Bragg angle (2θ±0.2°) of X-ray diffraction spectrum by CuKα characteristic X-ray have diffraction peaks at least on the positions of 7.3°, 16.0°, 24.9°, and 28.0°, 10 weight parts of vinyl chloride-vinyl acetate copolymer resin (VMCH, manufactured by Nippon Unicar Co., Ltd.) as the binder resin, and 200 weight parts of n-butyl acetate is dispersed in a sand mill with glass beads of 1 mmϕ for 4 hours. To the obtained dispersion are added 175 weight parts of n-butyl acetate and 180 weight parts of methyl ethyl ketone, and the mixture is stirred to obtain a coating solution for forming a charge generating layer. The coating solution is coated on the above under layer by dip coating, dried at room temperature to form a charge generating layer having a thickness of 0.2 μm.

Manufacture of Charge Transporting Layer:

45 weight parts of N,N'-diphenyl-N,N'-bis(3-methylphenyl)-[1,1']biphenyl-4,4'-diamine, and 55 weight parts of bisphenol Z polycarbonate resin (viscosity average molecular weight: 40,000) are added to 800 weight parts of chlorobenzene and dissolved, thereby a coating solution for forming a charge transporting layer is obtained. The coating solution is coated on the above charge generating layer by dip coating, dried at 130° C. for 45 minutes to form a charge transporting layer having a thickness of 23 μm.

Manufacture of Protective Layer:

3 weight parts of the above-exemplified Compound (III-17) as the charge transporting material, 3 weight parts of the above base resin 1, 0.1 weight parts of colloidal silica (PL-1, manufactured by Fuso Chemical Co., Ltd.), 0.1 parts of polyvinyl phenol resin (PVP, weight average molecular weight: about 8,000, manufactured by Aldrich), 5 weight parts of isopropyl alcohol, 5 weight parts of methyl isobutyl ketone, 0.2 weight parts of 3,5-di-t-butyl-4-hydroxytoluene (BHT), and 0.2 weight parts of NACURE 2500 (manufactured by King Industries Inc.) are mixed to prepare a coating solution for forming a protective layer. The coating solution is coated on the above charge transporting layer by dip coating, dried at room temperature for 30 minutes, and then cured by heat treatment at 150° C. for 1 hour to form a protective layer having a thickness of 5 μm, with which photoreceptor 1 is manufactured.

Figure 7:
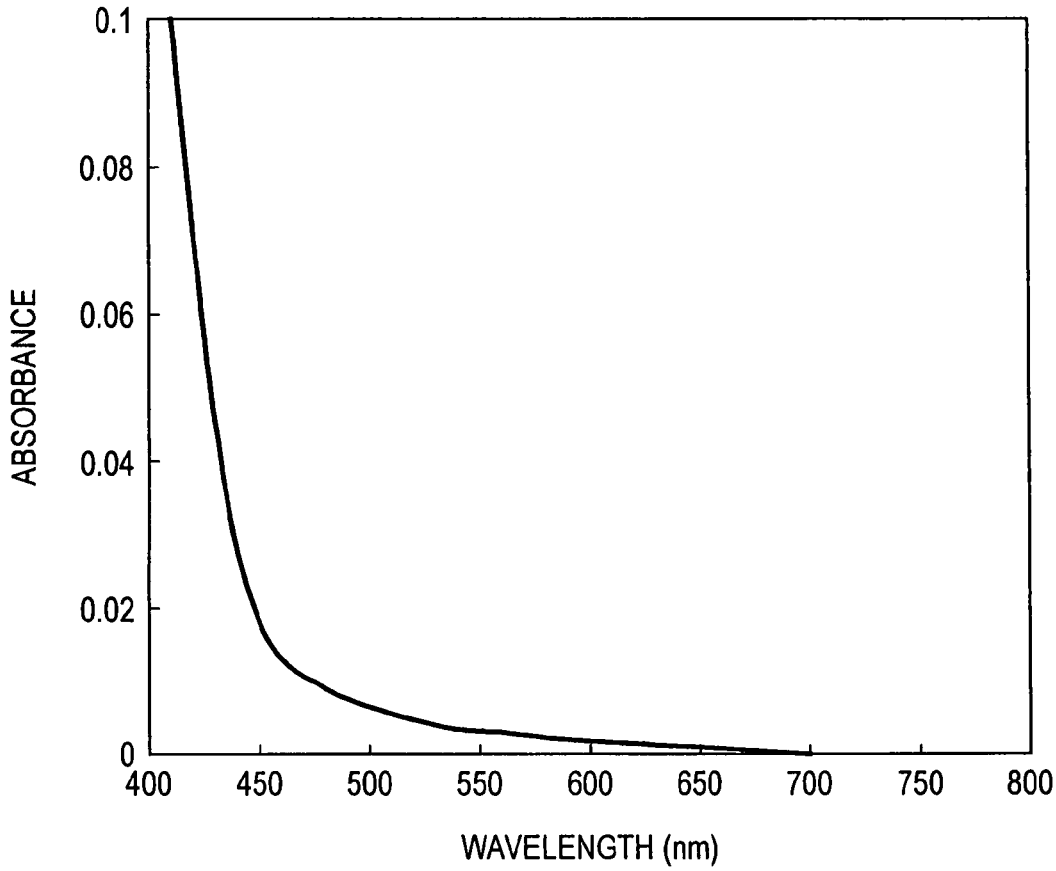
FIG. 7 is a graph showing the relationship between the wavelength of a light source and the absorbance of a protective layer.
Figure 8A:
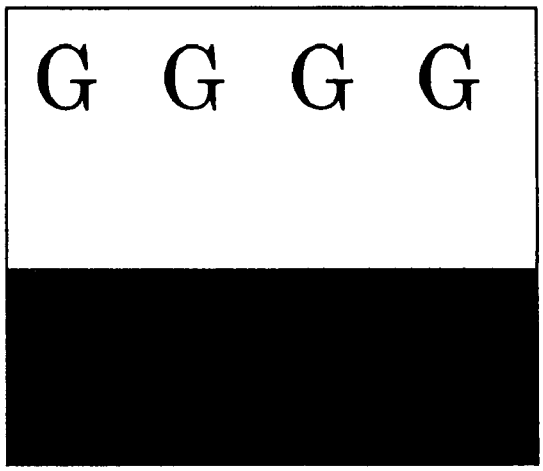
FIGS. 8A to 8C are views showing evaluation patterns and evaluation criterion of ghost.
Figure 8B:
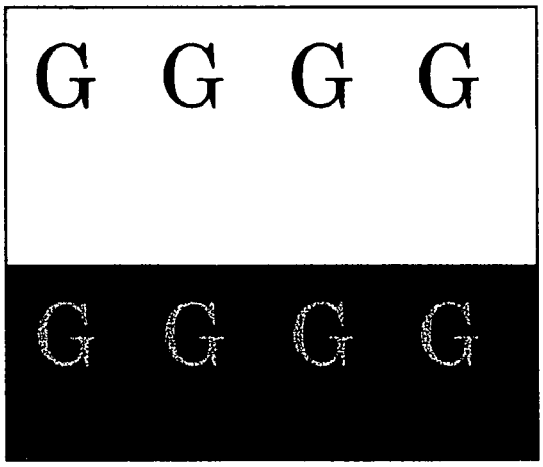
Figure 8C:
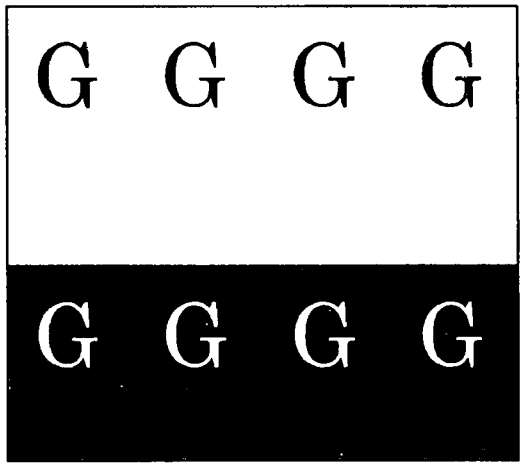

For measuring the absorption of the protective layer, a protective layer for measurement having a thickness of 50 μm, that is, 10 times the thickness of the protective layer, is manufactured on a glass preparation (S-1112, manufactured by Matsunami Glass Ind., Ltd.) by repeating the same manner as in the preparation of the above protective layer. The absorbances to the lights of wavelengths of from 400 to 800 nm of the obtained protective layer for measurement are measured with a spectrophotometer (U-4000, manufactured by Hitachi, Ltd.), and plotted in terms of the actual thickness of the protective layer of 5 μm. The results are shown in FIG. 7.

The maximum absorbance of the protective layer to each light source is found, with the light source having emission wavelength region of from 410 to 530 nm (E1L49-3B1A*-02, manufactured by Toyoda Gosei Co., Ltd.) as light source 1, the light source having emission wavelength region of from 430 to 560 nm (E1L53-SC1A*-03, manufactured by Toyoda Gosei Co., Ltd.) as light source 2, the light source having emission wavelength region of from 450 to 600 nm (E1L49-3G1A*-02, manufactured by Toyoda Gosei Co., Ltd.) as light source 3, and the light source having emission wavelength region of from 590 to 700 nm (E1L49-4ROA*-00, manufactured by Toyoda Gosei Co., Ltd.) as light source 4. The results obtained are shown in Table 17 below.

Photoreceptor 2:

Until the charge transporting layer, the same procedure as in photoreceptor 1 is repeated. In the next place, 3 weight parts of the exemplified Compound (1-3) as the charge transporting material, 3 weight parts of the above base resin 2, 0.3 weight parts of polyvinyl phenol resin (PVP, weight average molecular weight: about 8,000, manufactured by Aldrich), 5 weight parts of isopropyl alcohol, 5 weight parts of methyl isobutyl ketone, 0.1 weight parts of 3,5-di-t-butyl-4-hydroxytoluene (BHT), and 0.2 weight parts of NACURE 2500 (manufactured by King Industries Inc.) are mixed to prepare a coating solution for forming a protective layer. A protective layer having a thickness of 5 μm is formed and photoreceptor 2 is manufactured in the same manner as in the preparation of photoreceptor 1 except for using this coating solution. The absorption of the protective layer to each light source is found in the same manner as in photoreceptor 1, and the results obtained are shown in Table 17 below.

Photoreceptor 3:

Until the charge transporting layer, the same procedure as in photoreceptor 1 is repeated. In the next place, 3 weight parts of the exemplified Compound (II-5) as the charge transporting material, 3 weight parts of the above base resin 1, 0.1 weight parts of colloidal silica (PL-1, manufactured by Fuso Chemical Co., Ltd.), 5 weight parts of isopropyl alcohol, 5 weight parts of methyl isobutyl ketone, and 0.2 weight parts of NACURE 2500 (manufactured by King Industries Inc.) are mixed to prepare a coating solution for forming a protective layer. A protective layer having a thickness of 5 μm is formed and photoreceptor 3 is manufactured in the same manner as in the preparation of photoreceptor 1 except for using this coating solution. The absorption of the protective layer to each light source is measured in the same manner as in photoreceptor 1, and the results obtained are shown in Table 17.

Photoreceptor 4:

Until the charge transporting layer, the same procedure as in photoreceptor 1 is repeated. In the next place, 3 weight parts of the exemplified Compound (II-13) as the charge transporting material, 3 weight parts of the above base resin 3, 5 weight parts of isopropyl alcohol, 5 weight parts of methyl isobutyl ketone, and 0.1 weight parts of NACURE 2500 (manufactured by King Industries Inc.) are mixed to prepare a coating solution for forming a protective layer. A protective layer having a thickness of 4 μm is formed and photoreceptor 4 is manufactured in the same manner as in the preparation of photoreceptor 1 except for using this coating solution. The absorption of the protective layer to each light source is measured in the same manner as in photoreceptor 1, and the results obtained are shown in Table 17.

Photoreceptor 5:

Until the charge transporting layer, the same procedure as in photoreceptor 1 is repeated. In the next place, 3 weight parts of the exemplified Compound (IV-4) as the charge transporting material, 3 weight parts of the above base resin 1, 5 weight parts of isopropyl alcohol, 5 weight parts of methyl isobutyl ketone, and 0.2 weight parts of NACURE 2500 (manufactured by King Industries Inc.) are mixed to prepare a coating solution for forming a protective layer. A protective layer having a thickness of 4 μm is formed and photoreceptor 5 is manufactured in the same manner as in the preparation of photoreceptor 1 except for using this coating solution. The absorption of the protective layer to each light source is measured in the same manner as in photoreceptor 1, and the results obtained are shown in Table 17.

Photoreceptor 6:

Until the charge transporting layer, the same procedure as in photoreceptor 1 is repeated. In the next place, 3 weight parts of the exemplified Compound (III-8) as the charge transporting material, 3 weight parts of the above base resin 4, 5 weight parts of isopropyl alcohol, 5 weight parts of methyl isobutyl ketone, and 0.1 weight parts of NACURE 2500 (manufactured by King Industries Inc.) are mixed to prepare a coating solution for forming a protective layer. A protective layer having a thickness of 5 μm is formed and photoreceptor 6 is manufactured in the same manner as in the preparation of photoreceptor 1 except for using this coating solution. The absorption of the protective layer to each light source is measured in the same manner as in photoreceptor 1, and the results obtained are shown in Table 17.

Photoreceptor 7:

Until the charge transporting layer, the same procedure as in photoreceptor 1 is repeated. In the next place, 3 weight parts of the exemplified Compound (V-4) as the charge transporting material, 3 weight parts of the above base resin 1, 0.1 weight parts of colloidal silica (PL-1, manufactured by Fuso Chemical Co., Ltd.), 0.1 parts of polyvinyl phenol resin (PVP, weight average molecular weight: about 8,000, manufactured by Aldrich), 5 weight parts of isopropyl alcohol, weight parts of methyl isobutyl ketone, and 0.2 weight parts of NACURE 2500 (manufactured by King Industries Inc.) are mixed to prepare a coating solution for forming a protective layer. A protective layer having a thickness of 6 μm is formed and photoreceptor 7 is manufactured in the same manner as in the preparation of photoreceptor 1 except for using this coating solution. The absorption of the protective layer to each light source is measured in the same manner as in photoreceptor 1, and the results obtained are shown in Table 17.

Photoreceptor 8:

Until the charge transporting layer, the same procedure as in photoreceptor 1 is repeated. In the next place, 3 weight parts of the exemplified Compound (V-6) as the charge transporting material, 3 weight parts of the above base resin 4, 0.2 weight parts of colloidal silica (PL-1, manufactured by Fuso Chemical Co., Ltd.), 5 weight parts of isopropyl alcohol, 5 weight parts of methyl isobutyl ketone, and 0.1 weight parts of NACURE 2500 (manufactured by King Industries Inc.) are mixed to prepare a coating solution for forming a protective layer. A protective layer having a thickness of 5 μm is formed and photoreceptor 8 is manufactured in the same manner as in the preparation of photoreceptor 1 except for using this coating solution. The absorption of the protective layer to each light source is measured in the same manner as in photoreceptor 1, and the results obtained are shown in Table 17.

Photoreceptor 9:

Until the charge transporting layer, the same procedure as in photoreceptor 1 is repeated. In the next place, 3 weight parts of the above base resin 5, 3 weight parts of the exemplified Compound (II-10) as the charge transporting material, 0.5 weight parts of Irgacure 184 (manufactured by Ciba Specialty Chemicals Inc.), 0.1 weight parts of NACURE 2500 (manufactured by King Industries Inc.), 30 weight parts of tetrahydrofuran, and 10 weight parts of butanol are mixed to prepare a coating solution for forming a protective layer. The coating solution is coated on the above charge transporting layer by dip coating, dried at room temperature for 30 minutes, and then cured with a metal halide lamp (200 W, irradiation distance: 120 mm, irradiation intensity: 650 mW/cm$^2$) at the rotation speed of the photoreceptor of 10 rpm for 120 seconds. After that, curing reaction is further advanced at 150° C. for 30 minutes to form a protective layer having a thickness of 4 μm, with which photoreceptor 9 is manufactured. The absorption of the protective layer to each light source is measured in the same manner as in photoreceptor 1, and the results obtained are shown in Table 17.

TABLE 17

| | Constitution of Protective Layer | | | Maximum Absorbance of Protective Layer | | | |
|---|---|---|---|---|---|---|---|
| | Charge Carrying Material | Base Resin | Film Thickness (μm) | Light Source 1 | Light Source 2 | Light Source 3 | Light Source 4 |
| Photoreceptor-1 | III-17 | 1 | 5 | 0.10 | 0.045 | 0.018 | 0.002 |
| Photoreceptor-2 | I-3 | 2 | 5 | 0.07 | 0.032 | No absorption* | No absorption* |
| Photoreceptor-3 | II-5 | 1 | 5 | 0.08 | 0.003 | 0.016 | No absorption* |
| Photoreceptor-4 | II-13 | 3 | 4 | 0.09 | 0.004 | 0.002 | 0.001 |

TABLE 17-continued

| | Constitution of Protective Layer | | | Maximum Absorbance of Protective Layer | | | |
|---|---|---|---|---|---|---|---|
| | Charge Carrying Material | Film Base Resin | Film Thickness (μm) | Light Source 1 | Light Source 2 | Light Source 3 | Light Source 4 |
| Photoreceptor-5 | IV-4 | 1 | 4 | 0.10 | 0.006 | 0.014 | 0.002 |
| Photoreceptor-6 | III-8 | 4 | 5 | 0.06 | 0.003 | 0.002 | 0.001 |
| Photoreceptor-7 | V-4 | 1 | 6 | 0.12 | 0.003 | 0.002 | 0.001 |
| Photoreceptor-8 | V-6 | 4 | 5 | 0.08 | 0.005 | 0.004 | 0.001 |
| Photoreceptor-9 | II-10 | 5 | 4 | 0.04 | 0.003 | 0.002 | No absorption* |

*"No Absorption" means that the absorbance is less than the measuring limit (0.0005).

Example 1

The thus-manufactured photoreceptor 1 is mounted on DocuCentre Color 400CP (manufactured by Fuji Xerox Co., Ltd.). As the second exposure unit, the above light source 3 (E1L49-3G1A*-02) is installed between the cleaning unit and the charging unit to expose with the exposure intensity of 200 μW in the width of 5 mm on the photoreceptor constantly every image forming cycle (erase exposure, this is taken as exposure method 1). Thus, an image forming apparatus in Example 1 is obtained.

Evaluation of Image Quality:

In low temperature low humidity (10° C., 20% RH) and high temperature high humidity (30° C., 85% RH) environments, the following evaluations are performed. First, in a low temperature low humidity environment (10° C., 20% RH), continuous image forming test of 10 sheets is performed, and the ghost, image density and streak of the $10^{th}$ image are evaluated. After that, image forming test of 10,000 sheets is performed in the same environment, and the ghost, image density, streak and degradation of the $10{,}000^{th}$ image are evaluated, and compared with the $10^{th}$ image. The results obtained are shown in Table 18 below. Further, the reduced amount of the film thickness (abrasion loss) after image forming test of 10,000 sheets is measured.

The same test is performed in the high temperature high humidity (30° C., 85% RH) environment, and the ghost, image density, streak and image degradation are evaluated. The results obtained are shown in Table 18 below.

Evaluation of Ghost:

The chart of a pattern having letters G and black area as shown in FIGS. 8A to 8D is printed, and the state of appearance of letters G on the black solid part is visually evaluated.

A: Good to slight as in FIG. 8A.

B: A little stands out as in FIG. 8B.

C: Can be confirmed clearly as in FIG. 8C.

Evaluation of Image Density:

The evaluation of the image is performed by setting to be capable of obtaining the image of density of 20% on the first paper, and the image densities of the $10^{th}$ and $10{,}000^{th}$ are visually observed and judged.

A: The same density.

B: The density is a little reduced.

C: The density is clearly reduced.

Evaluation of Streak:

The same chart with the evaluation of ghost is used, and streak is visually judged.

A: Good.

B: The generation of streaks is partly observed.

C: Streaks problematic in image quality are generated.

Evaluation of Image Degradation:

The same chart with the evaluation of ghost is used, and image degradation is visually judged.

A: Good.

B: There is no problem during continuous print test, but image degradation is generated after printing 10,000 sheets and being allowed to stand for one day (24 hours).

C: Image degradation is generated during continuous printing.

Example 2

In Example 1, prior to initial printing of 10 sheets, the photoreceptor is subjected to pre-exposure with the second exposure unit during 100 revolutions in advance, and after that exposure is performed with the exposure intensity of 200 μW in the width of 5 mm on the photoreceptor constantly every image forming cycle (pre-exposure+erase exposure, this is taken as exposure method 2). An image forming apparatus in Example 2 is obtained in the same manner as in Example 1 except for the above. The obtained image forming apparatus is subjected to image quality evaluation test in the same manner as in Example 1. The results obtained are shown in Table 18.

Examples 3 to 17 And Comparative Examples 1 to 9

The image forming apparatus in Examples 3 to 17 and Comparative Examples 1 to 9 are manufactured and the image quality evaluation test is carried out in the same manner as in Example 1, except for changing the combinations of the photoreceptor, exposure light source, exposure intensity and exposure method as shown in Table 18. The results obtained are shown in Table 18.

TABLE 18

| | Photoconductor | Light Source | Exposure Method | Max. Absorbance of Protective Layer | Exposure Intensity (μW) |
|---|---|---|---|---|---|
| Ex. 1 | 1 | 3 | 1 | 0.018 | 200 |
| Ex. 2 | 1 | 3 | 2 | 0.018 | 200 |
| Ex. 3 | 2 | 2 | 1 | 0.032 | 150 |

TABLE 18-continued

| | | | | | |
|---|---|---|---|---|---|
| Ex. 4 | 2 | 2 | 2 | 0.032 | 150 |
| Ex. 5 | 3 | 2 | 1 | 0.003 | 150 |
| Ex. 6 | 3 | 3 | 1 | 0.016 | 150 |
| Ex. 7 | 4 | 3 | 1 | 0.002 | 200 |
| Ex. 8 | 4 | 3 | 2 | 0.002 | 200 |
| Ex. 9 | 4 | 4 | 1 | 0.001 | 500 |
| Ex. 10 | 5 | 3 | 1 | 0.014 | 200 |
| Ex. 11 | 5 | 4 | 1 | 0.002 | 500 |
| Ex. 12 | 6 | 2 | 1 | 0.003 | 200 |
| Ex. 13 | 6 | 3 | 1 | 0.002 | 200 |
| Ex. 14 | 7 | 4 | 1 | 0.001 | 500 |
| Ex. 15 | 8 | 2 | 1 | 0.005 | 300 |
| Ex. 16 | 8 | 3 | 1 | 0.004 | 500 |
| Ex. 17 | 9 | 2 | 2 | 0.003 | 100 |
| Comp. 1 | 1 | 1 | 2 | 0.10 | 200 |
| Comp. 2 | 2 | 4 | 2 | No absorption | 2,000 |
| Comp. 3 | 3 | 4 | 2 | No absorption | 2,000 |
| Comp. 4 | 4 | 1 | 1 | 0.09 | 100 |
| Comp. 5 | 5 | 1 | 1 | 0.10 | 100 |
| Comp. 6 | 6 | 1 | 1 | 0.06 | 200 |
| Comp. 7 | 7 | 1 | 1 | 0.12 | 100 |
| Comp. 8 | 8 | 1 | 1 | 0.08 | 100 |
| Comp. 9 | 9 | 4 | 2 | No absorption | 2,000 |

| | Low Temperature Low Humidity (10° C., 20% RH) | | | | | | | |
|---|---|---|---|---|---|---|---|---|
| | Low Temp. Low Humid., 10th sheets | | | Low Temperature Low Humidity, 10,000$^{th}$ Sheets | | | | |
| | Ghost | Image Density | Streak | Ghost | Image Density | Streak | Image Degradation | Abrasion Loss (μm) |
| Ex. 1 | B | A | A | A | A | A | A | 0.3 |
| Ex. 2 | A | A | A | A | A | A | A | 0.3 |
| Ex. 3 | B | A | A | A | A | A | A | 0.6 |
| Ex. 4 | A | A | A | A | A | A | A | 0.6 |
| Ex. 5 | B | A | A | A | A | A | A | 0.2 |
| Ex. 6 | B | A | A | A | A | A | A | 0.2 |
| Ex. 7 | A | A | A | A | A | A | A | 0.5 |
| Ex. 8 | A | A | A | A | A | A | A | 0.5 |
| Ex. 9 | B | A | A | A | A | A | A | 0.5 |
| Ex. 10 | A | A | A | A | A | A | A | 0.4 |
| Ex. 11 | A | A | A | A | A | A | A | 0.4 |
| Ex. 12 | B | A | A | A | A | A | A | 0.3 |
| Ex. 13 | A | A | A | A | A | A | A | 0.3 |
| Ex. 14 | A | A | A | A | A | A | A | 0.3 |
| Ex. 15 | B | A | A | A | A | A | A | 0.5 |
| Ex. 16 | A | A | A | A | A | A | A | 0.5 |
| Ex. 17 | B | A | A | A | A | A | A | 0.7 |
| Comp. 1 | A | A | A | A | B | C | B | 0.3 |
| Comp. 2 | C | A | A | C | A | A | A | 0.6 |
| Comp. 3 | C | A | A | C | A | A | A | 0.2 |
| Comp. 4 | A | A | A | A | B | C | B | 0.5 |
| Comp. 5 | A | A | A | A | B | C | B | 0.4 |
| Comp. 6 | A | A | A | A | C | B | C | 0.3 |
| Comp. 7 | A | A | A | A | B | C | B | 0.5 |
| Comp. 8 | A | A | A | A | B | C | B | 0.5 |
| Comp. 9 | C | A | A | C | A | A | A | 0.7 |

| | High Temperature High Humidity (30° C., 85% RH) | | | | | | |
|---|---|---|---|---|---|---|---|
| | High Temp. High Humid., 10$^{th}$ Sheet | | | High Temp. High Humid., 10,000$^{th}$ Sheet | | | |
| | Ghost | Image Density | Streak | Ghost | Image Density | Streak | Image Degradation |
| Ex. 1 | A | A | A | A | A | A | A |
| Ex. 2 | A | A | A | A | A | A | A |
| Ex. 3 | A | A | A | A | A | A | A |
| Ex. 4 | A | A | A | A | A | A | A |
| Ex. 5 | A | A | A | A | A | A | A |
| Ex. 6 | A | A | A | A | A | A | A |
| Ex. 7 | A | A | A | A | A | A | A |
| Ex. 8 | A | A | A | A | A | A | A |
| Ex. 9 | A | A | A | A | A | A | A |
| Ex. 10 | A | A | A | A | A | A | A |
| Ex. 11 | A | A | A | A | A | A | A |
| Ex. 12 | A | A | A | A | A | A | A |
| Ex. 13 | A | A | A | A | A | A | A |

TABLE 18-continued

| | | | | | | | |
|---|---|---|---|---|---|---|---|
| Ex. 14 | A | A | A | A | A | A | A |
| Ex. 15 | A | A | A | A | A | A | A |
| Ex. 16 | A | A | A | A | A | A | A |
| Ex. 17 | A | A | A | A | A | A | A |
| Comp. 1 | A | A | A | A | C | B | C |
| Comp. 2 | C | A | A | C | A | A | B |
| Comp. 3 | C | A | A | C | A | A | B |
| Comp. 4 | A | A | A | A | B | C | C |
| Comp. 5 | A | A | A | A | B | B | C |
| Comp. 6 | A | A | A | A | B | C | C |
| Comp. 7 | A | A | A | B | C | B | C |
| Comp. 8 | A | A | A | B | C | B | C |
| Comp. 9 | C | A | A | C | A | A | A |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor comprising a conductive support and a photosensitive layer including an outermost surface layer capable of transporting a charge, the outermost surface layer being farthest from the conductive support and containing a resin having a crosslinking structure;

a charging unit that charges the electrophotographic photoreceptor;

a first exposure unit that exposes the electrophotographic photoreceptor to form an electrostatic latent image on the electrophotographic photoreceptor charged;

a developing unit that develops the electrostatic latent image with a toner to form a toner image;

a transfer unit that transfers the toner image from the electrophotographic photoreceptor to a medium to be transferred; and a second exposure unit that uniformly exposes the electrophotographic photoreceptor, the outermost surface layer of the electrophotographic photoreceptor absorbing exposure light of the second exposure unit and having a maximum absorbance of about 0.05 or less in the entire wavelength range of the exposure light of the second exposure unit, wherein the second exposure unit comprises a controller that controls a quantity of the exposure light, the second exposure unit comprises a controller that controls exposure timing so as to uniformly irradiate the electrophotographic photoreceptor with the exposure light at irregular timings during one of a single erase exposure and a single pre-exposure prior to an image forming cycle, and the second exposure unit comprises a light source including a semiconductor element.

2. The image forming apparatus according to claim 1, wherein the maximum absorbance of the outermost surface layer is from 0.001 to 0.047.

3. The image forming apparatus according to claim 1, wherein the maximum absorbance of the outermost surface layer is from 0.002 to 0.045.

4. The image forming apparatus according to claim 1, wherein the outermost surface layer has a thickness of about 2 μm or more.

5. The image forming apparatus according to claim 1, wherein the resin having the crosslinking structure contains at least one resin selected from the group consisting of a silicone resin, an epoxy resin, an acrylic resin, a phenolic resin and a melamine resin.

6. The image forming apparatus according to claim 1, wherein the outermost surface layer contains a charge transporting material.

7. The image forming apparatus according to claim 6, wherein the charge transporting material includes at least one compound represented by one of formulae (I) to (V):

$$F[-(X^1)_{n1}R^1—CO_2H]_{m1} \quad (I)$$

wherein F represents an organic group derived from a compound capable of transporting a hole; $R^1$ represents an alkylene group; $X^1$ represents an oxygen atom or a sulfur atom; m1 represents an integer of from 1 to 4; and n1 represents 0 or 1, $$F[-(X^2)_{n2}—(R^2)_{n3}—(Z^2)_{n4}G]_{n5} \quad (II)$$

wherein F represents an organic group derived from a compound capable of transporting a hole; $X^2$ represents an oxygen atom or a sulfur atom; $R^2$ represents an alkylene group; $Z^2$ represents an alkylene group, an oxygen atom, a sulfur atom, NH or COO; G represents a hydrogen atom, an epoxy group, an acryl group, a methacryl group, or a monovalent group having an alkoxyxilyl group; n2, n3 and n4 each represents 0 or 1; and n5 represents an integer of from 1 to 4, (III)

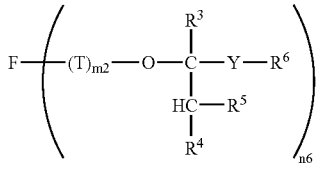

wherein F represents an organic group derived from a compound capable of transporting a hole; T represents a divalent group; Y represents an oxygen atom or a sulfur atom; $R^3$, $R^4$ and $R^5$ each independently represents a hydrogen atom or a monovalent organic group; $R^6$ represents a monovalent organic group; m2 represents 0 or 1; and n6 represents an integer of from 1 to 4, provided that $R^5$ and $R^6$ may be bonded to each other to form a heterocyclic ring including Y as an hetero atom,

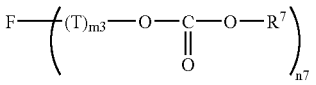

(IV)

wherein F represents an organic group derived from a compound capable of transporting a hole; T represents a divalent linking group; $R^7$ represents a monovalent organic group; m3 represents 0 or 1; and n7 represents an integer of from 1 to 4, and

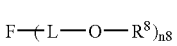

(V)

wherein F represents an organic group derived from a compound capable of transporting a hole; $R^8$ represents a monovalent organic group; L represents an alkylene group; and n8 represents an integer of from 1 to 4.

8. The image forming apparatus according to claim 1, wherein the outermost surface layer is a layer cured with an acid catalyst.

9. The image forming apparatus according to claim 8, wherein the acid catalyst is a sulfur-containing catalyst.

10. The image forming apparatus according to claim 1, further comprising a process cartridge integrally having: the electrophotographic photoreceptor; and at least one selected from the group consisting of the charging unit, the second exposure unit, the developing unit, and a cleaning unit that removes the toner remaining on the electrophotographic photoreceptor, the process cartridge being detachable from a main body of the image forming apparatus.

11. The image forming apparatus according to claim 1, wherein the second exposure unit uniformly exposes the electrophotographic photoreceptor with light of from about 20 μW to 5 mW.

12. A process cartridge comprising:

an electrophotographic photoreceptor comprising a conductive support and a photosensitive layer including an outermost surface layer capable of transporting an charge , the outermost surface layer being farthest from the conductive support and containing a resin having a crosslinking structure; and an exposure unit that uniformly expose the electrophotographic photoreceptor, the outermost surface layer of the electrophotographic photoreceptor absorbing exposure light of the exposure unit and having a maximum absorbance of about 0.05 or less in the entire wavelength range of the exposure light, wherein the exposure unit comprises a controller that controls irradiation of the exposure light so as to irregularly irradiate the electrophotographic photoreceptor with the exposure light, the exposure unit comprises a controller that controls exposure timing so as to uniformly irradiate the electrophotographic photoreceptor with the exposure light at irregular timings during one of a single erase exposure and a single pre-exposure prior to an image forming cycle, and the exposure unit uniformly exposes the electrophotographic photoreceptor with light of from about 20 μW to 5 mW.

* * * * *